US006695439B2

(12) United States Patent
Takahashi

(10) Patent No.: US 6,695,439 B2
(45) Date of Patent: Feb. 24, 2004

(54) PIEZOELECTRIC TRANSDUCER AND LIQUID DROPLET EJECTION DEVICE

(75) Inventor: Yoshikazu Takahashi, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 89 days.

(21) Appl. No.: 10/109,907

(22) Filed: Mar. 28, 2002

(65) Prior Publication Data

US 2002/0140787 A1 Oct. 3, 2002

(30) Foreign Application Priority Data

Mar. 29, 2001 (JP) ..... P2001-095983
Mar. 29, 2001 (JP) ..... P2001-096425
Mar. 29, 2001 (JP) ..... P2001-097134
Mar. 22, 2002 (JP) ..... P2002-080286

(51) Int. Cl.[7] ..... B41J 2/045
(52) U.S. Cl. ..... 347/72
(58) Field of Search ..... 347/68–72; 310/359, 310/328, 322, 324

(56) References Cited

U.S. PATENT DOCUMENTS 4,584,590 A 4/1986 Fischbeck et al.
5,266,964 A 11/1993 Takahashi et al.
5,402,159 A 3/1995 Takahashi et al.
5,639,508 A * 6/1997 Okawa et al. ..... 347/72
5,643,379 A * 7/1997 Takeuchi et al. ..... 347/72
5,767,612 A * 6/1998 Takeuchi et al. ..... 310/324
5,912,526 A * 6/1999 Okawa et al. ..... 310/328

* cited by examiner

*Primary Examiner*—Stephen Meier
*Assistant Examiner*—An H. Do
(74) *Attorney, Agent, or Firm*—Pitney, Hardin, Kipp & Szuch LLP

(57) ABSTRACT

A piezoelectric transducer 10 includes a piezoelectric plate 11, in which a plurality of piezoelectric ceramic layers 11*a*–11*d* are stacked one on another. The piezoelectric plate 11 is polarized in directions symmetrically with the center of each ink chamber 24 and slanted with respect to both of the surface direction and the thickness direction of the piezoelectric plate 11. A pair of driving electrodes 12 and 13 are provided on the opposite surfaces of the piezoelectric plate 11. When an electric field, which extends substantially perpendicularly with the polarized directions, is applied by the driving electrodes 12, 13 through the piezoelectric plate 11, the piezoelectric plate 11 is deformed in a shear mode fashion, thereby applying an ejection pressure to ink accommodated inside the ink chamber 24.

27 Claims, 17 Drawing Sheets

PIEZOELECTRIC TRANSDUCER AND LIQUID DROPLET EJECTION DEVICE

BACKGROUND OF THE INVENTION

1. Field of the Invention

The present invention relates to a piezoelectric transducer and a liquid droplet ejection device that employs the piezoelectric transducer.

2. Description of Related Art

There has been proposed a print head of a drop-on-demand type. This print head employs a piezoelectric type liquid droplet ejection device that prints letters, characters, and images on a sheet of paper in a dot-matrix form. More specifically, the piezoelectric type liquid droplet ejection device includes a number of ink ejection units, which are arranged close to one another. Each ink ejection unit includes a piezoelectric transducer and a liquid chamber that is filled with ink. By changing the size of the piezoelectric transducer, it is possible to change the volume of the liquid chamber. When the volume decreases, ink is ejected out the liquid chamber via a corresponding nozzle. When the volume increases, ink is supplied into the liquid chamber from an ink supply source. By controlling ink ejection units at selected positions, it is possible to produce desired letters, desired characters, and desired images.

There has been a piezoelectric type liquid droplet ejection device, in which a piezoelectric plate is provided over a plurality of liquid chambers. In this type of device, the piezoelectric plate is deformed locally at a desired position that corresponds to a selected liquid chamber. In order to deform piezoelectric material, there have been proposed two types of modes: a direct mode, and a shear mode.

The direct mode is described in the U.S. Pat. No. 5,402,159. According to the direct mode described in this publication, a plurality of piezoelectric ceramic layers are stacked one on another. Positive and negative electrodes are alternately disposed in the laminated piezoelectric ceramic layers so that each electrode is sandwiched between two adjacent piezoelectric ceramic layers. Each piezoelectric ceramic layer, located between positive and negative electrodes, is polarized in a direction along which the positive and negative electrodes oppose with each other. When a voltage is applied between the positive and negative electrodes, the piezoelectric ceramic layer expands along the polarized direction due to an electric field that extends in the same direction with the polarized direction. As a result, the volume of the corresponding liquid chamber is changed, and ink is applied with a pressure and is ejected.

The shear mode is described in the U.S. Pat. No. 5,266,964. Also according to the shear mode described in this publication, a plurality of piezoelectric ceramic layers are stacked one an another. A group of positive electrodes is provided in the laminated piezoelectric ceramic layers so that each positive electrode is sandwiched between two adjacent piezoelectric ceramic layers. A group of negative electrodes is provided in the laminated piezoelectric ceramic layers at a location that is distant from the position where the positive electrode group is provided in a direction perpendicular to the direction, in which the piezoelectric ceramic layers are laminated. Also in the negative electrode group, each negative electrode is sandwiched between two adjacent piezoelectric ceramic layers. The part of the piezoelectric-ceramic layer lamination, between the positive electrode group and the negative electrode group, is polarized in a direction perpendicular to the direction, in which the positive electrode group and the negative electrode group oppose with each other. When a voltage is applied between the positive and negative electrode groups, the part of the piezoelectric ceramic layer lamination, between those electrodes, is applied with an electric field that is perpendicular to the polarized direction. As a result, the piezoelectric ceramic layer lamination is deformed in a shear-mode, that is, in a parallelogram shape. As a result, the volume of a corresponding liquid chamber is changed, and ink is applied with a pressure and is ejected.

SUMMARY OF THE INVENTION

In the direct mode, however, it is necessary to stack a great number of ceramic layers and a great number of electrodes one on another in order to attain a desired large amount of deformation. In the shear mode, each positive (negative) electrode is oriented so that its surface does not oppose to the corresponding negative (positive) electrode. Each positive (negative) electrode faces in a direction perpendicular to the direction, in which the electrode opposes with the negative (positive) electrode. It is therefore necessary to provide a large number of electrodes in each group of electrodes 50 that it appears that each electrode group has a large amount of area opposed with a corresponding opposite-polarity electrode group.

In this way, it is necessary to employ a great number of steps to manufacture the liquid droplet ejection device of each mode. More specifically, in order to manufacture the liquid droplet ejection device of each mode, a great number of ceramic green sheets are first prepared A plurality of electrodes are formed on each green sheet, by providing electrode material on the green sheet by screen printing or vapor deposition. On each green sheet, the plurality of electrodes are located at positions corresponding to a plurality of liquid chambers. The green sheets thus formed with the electrodes are then stacked one on another. At this process, it is necessary to stack the green sheets so that the electrodes on the green sheets will be located one on another accurately.

In view of the above-described drawbacks, it is an objective of the present invention to provide an improved piezoelectric transducer that can obtain a desired large amount of deformation even with a small number of electrodes and to provide an improved liquid droplet ejection device that employs the improved piezoelectric transducer In order to attain the above and other objects, the present invention provides a piezoelectric transducer, comprising: a piezoelectric plate, which is made of piezoelectric material and which has a pair of opposite surfaces, the piezoelectric plate having at least one actuating portion desired to be deformed and at least two non-actuating portions, each actuating portion being located as being interposed between corresponding two non-actuating portions, each actuating portion having a center, the piezoelectric plate being polarized in a pair of polarized directions, which are slanted with respect to both of a surface direction and a thickness direction and which are symmetrical with respect to the center of each actuating portion, the surface direction being defined along the opposite surfaces of the piezoelectric plate, the thickness direction being defined along a thickness of the piezoelectric plate and substantially perpendicular to the surface direction; and a pair of driving electrodes, each of which is provided on a corresponding surface of the piezoelectric plate, the pair of driving electrodes being for applying an electric field that extends substantially perpendicularly to the polarized directions, thereby causing the actuating portion to be deformed in a direction substantially perpendicular to the surface direction, that is, in a shear-mode.

It is possible to polarize the piezoelectric plate in the direction slanted with respect to both of the surface direction and the thickness direction, by providing a pair of polarizing electrodes at positions so that the pair of polarizing electrodes will oppose with each other along a direction slanted with respect to the surface direction. In such a cases an imaginary line connecting between the pair of polarizing electrodes extends along the direction slanted with respect to the surface direction.

It is noted that the pair of polarizing electrodes may be provided outside the piezoelectric plate, or inside the piezoelectric plate but at locations near to the opposite surfaces of the piezoelectric plate.

It is possible to effectively deform the piezoelectric plate, by providing a pair of driving electrodes on the opposite surfaces of the piezoelectric plate so that they oppose with each other and so that they apply an electric field substantially perpendicularly to the slanted polarized directions. In this way, it is possible to effectively deform the piezoelectric plate even with using a small number of electrodes.

It is possible to deform the piezoelectric plate in a direction substantially perpendicular to the surface direction, by locating the polarizing electrodes symmetrically with respect to the center of each actuating portion and by locating the driving electrodes symmetrically with respect to the center of each actuating portion.

The piezoelectric plate may be provided with no polarizing electrodes. However, it may be possible to provide the piezoelectric plate with a pair of polarizing electrodes. For example, the pair of polarizing electrodes may be provided in the interior of the piezoelectric plate as internal polarizing electrodes.

According to another aspect, the present invention provides a piezoelectric transducer, comprising: a piezoelectric plate which is made of piezoelectric material and which has a pair of opposite surfaces, the pair of opposite surfaces extending in a predetermined surface direction and being opposed to each other along a predetermined thickness direction, the predetermined thickness direction being substantially perpendicular to the predetermined surface direction; a first electrode group and a second electrode group provided to the piezoelectric plate, the first electrode group and the second electrode group being distant from each other in the thickness direction, the first electrode group including a plurality of first electrodes arranged in the surface direction as being separated from one another, and the second electrode group including a plurality of second electrodes arranged in the surface direction as being separated from one another, the plurality of first and second electrodes including; at least one polarizing combination of first and second electrodes, between which a polarizing electric field is to be applied to polarize the piezoelectric plate; and at least one driving combination of first and second electrodes, between which a driving electric field is to be applied to actuate the piezoelectric plate, the driving combination of first and second electrodes being different from the polarizing combination of first and second electrodes, an imaginary line connecting between the driving combination of first and second electrodes substantially intersecting with an imaginary line connecting between the polarizing combination of first and second electrodes, thereby allowing the piezoelectric plate to be deformed in a shear mode fashion, that is, substantially perpendicularly to the surface direction, upon driven by the driving combination of first and second electrodes.

According to another aspect, the present invention provides a liquid droplet ejection device, comprising: a piezoelectric plate, which is made of piezoelectric material and which has a pair of opposite surfaces, the piezoelectric plate having at least one actuating portion desired to be deformed, the pair of opposite surfaces extending in a predetermined surface direction and being opposed to each other along a predetermined thickness direction, the predetermined thickness direction being substantially perpendicular to the predetermined surface direction; and a wall having at least two partition walls that define at least one liquid chamber therebetween, the liquid chamber being filled with liquid, the wall being connected to one of the pair of opposite surfaces of the piezoelectric plate so that each actuating portion in the piezoelectric plate is located at a position corresponding to a corresponding liquid chamber, the center of the actuating portion corresponding to the center of the liquid chamber, the piezoelectric plate being polarized in a pair of polarized directions at a pair of polarized portions in each actuating portion, the pair of polarized portions being defined as a pair of regions between a position corresponding to the center of the liquid chamber and a position corresponding to the two partition walls that sandwich the liquid chamber therebetween, the polarized directions being symmetrical with each other with respect to the center of the liquid chamber and slanted with respect to both of the thickness direction and the surface direction; and a pair of driving electrodes, each of which is provided on a corresponding surface of the piezoelectric plate, the pair of driving electrodes being for applying an electric field that extends substantially perpendicularly to the polarized directions, thereby causing the actuating portion to be deformed in a direction substantially perpendicular to the surface direction, that is, in a shear-mode fashion, to thereby change the volume of the liquid chamber and allow the liquid to be ejected from the liquid chamber.

According to another aspect, the present invention provides a liquid droplet ejection device, comprising: a piezoelectric plate which is made of piezoelectric material and which has a pair of opposite surfaces, the pair of opposite surfaces extending in a predetermined surface direction and being opposed to each other along a predetermined thickness direction, the predetermined thickness direction being substantially perpendicular to the predetermined surface direction; a liquid chamber unit defining a plurality of liquid chambers, the liquid chamber unit being connected to one of the pair of opposite surfaces of the piezoelectric plate, the piezoelectric plate being provided over the plurality of liquid chambers; a first electrode group and a second electrode group provided to the piezoelectric plate, the first electrode group and the second electrode group being distant from each other in the thickness direction, the first electrode group including a plurality of first electrodes arranged in the surface direction as being separated from one another, the second electrode group including a plurality of second electrodes arranged in the surface direction as being separated from one another; and an energizing unit applying a polarizing electric field between at least one polarizing combination of first and second electrodes, and applying a driving electric field between at least one driving combination of first and second electrodes, the driving combination of first and second electrodes being different from the polarizing combination of first and second electrodes, an imaginary line connecting between the driving combination of first and second electrodes substantially intersecting with an imaginary line connecting between the polarizing combination of first and second electrodes, whereby the energizing unit allows the piezoelectric plate to be deformed in a shear mode fashion, that is, substantially perpendicularly to the surface direction, when applying the driving electric field between the driving combination of first and second electrodes, thereby allowing the volume of the liquid chamber to be changed and allowing the liquid chamber to eject a liquid droplet therefrom.

BRIEF DESCRIPTION OF THE DRAWINGS

The above and other objects, features and advantages of the invention will become more apparent from reading the following description of the preferred embodiments taken in connection with the accompanying drawings in which.

DETAILED DESCRIPTION OF THE PREFERRED EMBODIMENTS

Figure 1:
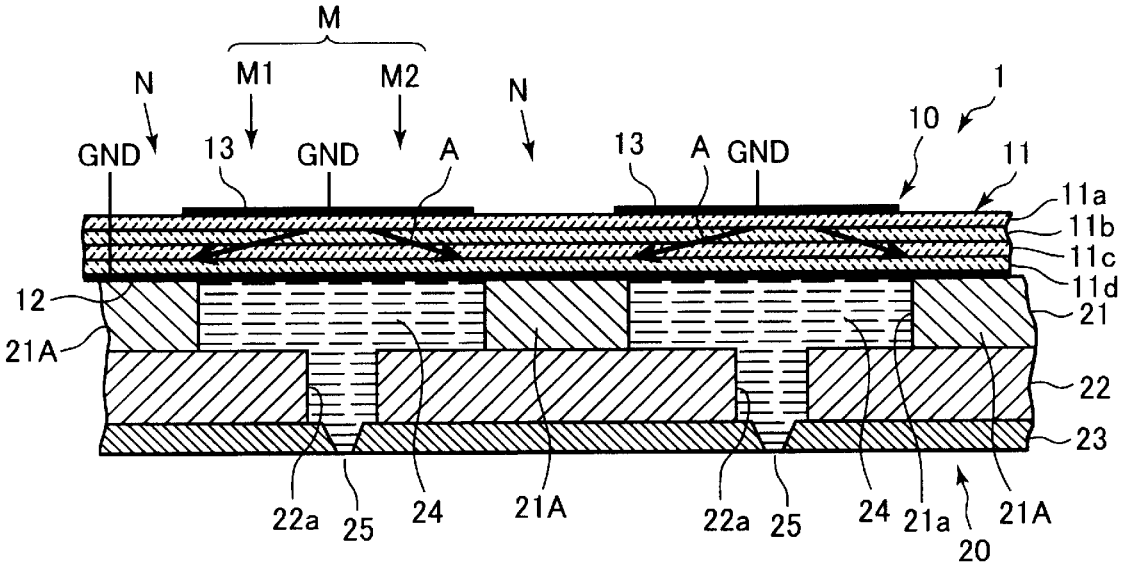
FIG. 1 is a cross-sectional view showing an ink ejection device that employs a piezoelectric transducer according to a first embodiment of the present invention.

A piezoelectric transducer and a liquid droplet ejection device according to preferred embodiments of the present invention will be described while referring to the accompanying drawings wherein like parts and components are designated by the same reference numerals to avoid duplicating description.

First Embodiment

A piezoelectric transducer and a liquid droplet ejection device according to a first embodiment of the present invention will be described with reference to FIGS. 1 through 9. The following description pertains to an ink ejection device to which the first embodiment is applied.

As shown in FIG. 1, the ink ejection device 1 includes: a piezoelectric transducer 10 and an ink chamber unit 20. The ink chamber unit 20 includes an ink chamber plate 21, a spacer plate 22, and a nozzle plate 23 formed with nozzles 25.

Figure 4:
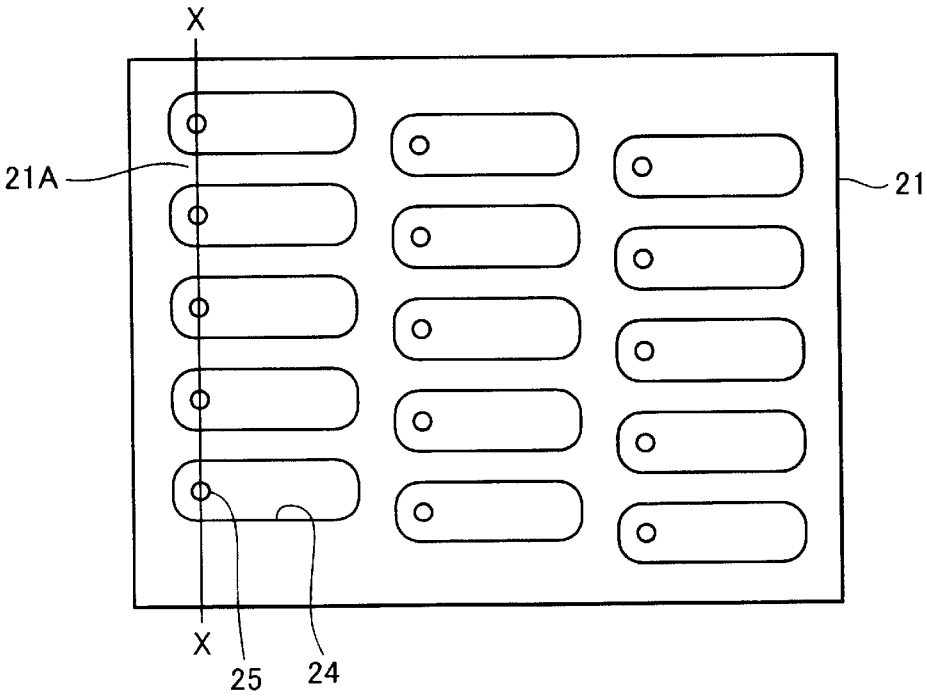
FIG. 4 is a plan view showing a distribution of ink chambers in the first embodiment.

The ink chamber plate 21 is formed with a plurality of through-holes 21*a*, and provides a plurality or partition walls 21A at its solid portions other than the through-holes 21*a*. One open end of each through-hole 21*a* is covered with the piezoelectric transducer 10, and another open end is covered with the spacer plate 22. In this way, a plurality of ink chambers 24 are formed as being arranged in a plurality of rows and columns as shown in FIG. 4 in a two dimensional plane. It is noted that FIG. 1 shows a part of a cross-section taken along a line X—X in FIG. 4. Neighboring ink chambers 24 are separated by the partition walls 21A. The spacer plate 22 is formed with a plurality of communication holes 22*a* in communication with the ink chambers 24. The ink chamber 24 has an elongated shape (extending in a direction perpendicular to a sheet of FIG. 1). As shown in FIG. 4, one distal end portion of each ink chamber 24 is in communication with a corresponding nozzle 25 through a corresponding communication hole 22*a*, and another distal end portion of each ink chamber 24 is in communication with an ink supply source (not shown). Each ink chamber 24 has a width (in a leftward/rightward direction in FIG. 1, or along a line X—X in FIG. 4) of 0.375 mm, and a length (extending in a direction perpendicular to the sheet of FIG. 1, or in a direction perpendicular to the line X—X in FIG. 4) of 2.000 mm. The ink chambers 24 are arrayed at a constant pitch of 0.508 mm (50 DPI) in the leftward/rightward direction in FIG. 1 and in a line X—X of FIG. 4.

The piezoelectric transducer 10 is in the form of a piezoelectric plate 11 made from a lead zirconate titanate (PZT) ceramic material. The piezoelectric plate 11 is constituted by a plurality of sheet like piezoelectric ceramic layers 11*a* through 11*d* stacked one on another. A single first driving electrode 12 is formed at a surface of the piezoelectric plate 11, the surface being in confrontation with the ink chambers 24, and a plurality of second driving electrodes 13 are formed at an opposite surface of the piezoelectric plate 11, the opposite surface being at a side opposite to the ink chambers 24. The first driving electrode 12 is formed over an entire surface (lower surface in FIG. 1) of the piezoelectric plate 11 as a common electrode for the ink chambers 24. Each second driving electrode 13 is provided for each ink chamber 24, and has a shape substantially in conformity with the shape of the ink chamber 24. In this way, the plurality of second electrodes 13 are provided in one-to-one correspondence with the plurality of ink chambers 24, and serve as a plurality of units, to which driving voltages will be applied independently from one another.

Each piezoelectric ceramic layer 11*a*–11*d* has thickness of 0.015 mm. The first and second driving electrodes 12 and 13 are made from Ag—Pd metal, and has a thickness of about 0.002 mm. It is noted that the direction, in which the surfaces of piezoelectric plate 11 extend, will be referred to as "surface direction", and that the direction, in which the thickness of the piezoelectric plate 11 is defined, will be referred to as "thickness direction" hereinafter.

A portion of the piezoelectric plate 11, that corresponds to each ink chamber 24, functions as a deformable part, i.e., operating part M. This operating part M is interposed between a corresponding second electrode 13 and the first electrode 12. The operating part M has the lateral center (center in the leftward/rightward direction of FIG. 1) that is located in correspondence with the lateral center (center in the leftward/rightward direction of FIG. 1) of a corresponding ink chamber 24. Another portion of the piezoelectric plate 11, that corresponds to each partition wall 21A, functions as a non-deformable part, i.e., non-operating part N.

In each operating part M, the piezoelectric plate 11 is symmetrically polarized with respect to the center (lateral center in the leftward/rightward direction of FIG. 1) thereof as indicated by arrows A in FIG. 1. In other words, in each operating part M, the piezoelectric plate 11 is symmetrically polarized with respect to the center (lateral center in the leftward/rightward direction of FIG. 1) of the corresponding ink chamber 24. More specifically, the piezoelectric plate 11 is symmetrically polarized in a pair of different directions that are directed from the center of the operating part M toward a pair of non-operating parts N that are provided on both sides of the operating part M. In other words, the piezoelectric plate 11 is symmetrically polarized in the pair of different directions from the center of the corresponding ink chamber 24 toward a pair of partition walls 21A that are provided on both sides of the corresponding ink chamber 24.

Each of the pair of polarizing directions is primarily directed along the surfaces of the piezoelectric plate 11, that is, along the surface direction, but is slightly slanted toward the thickness direction. Each polarizing direction therefore has a component extending along the surfaces of the piezoelectric plate 11 (surface direction). In this way, each operating part M has a pair of polarization portions M1 and M2. The pair of polarization portions M1 and M2 are defined as a pair of regions symmetrical with respect to the center of the operating part M so that each portion M1, M2 extends from the center of the operating part M toward a corresponding non-operating part N (corresponding partition wall 21A). Each polarization portion M1, M2 is polarized in a direction from the center of the operating part M (center of the ink chamber 24) toward the corresponding non-operating part N (corresponding partition wall 21A), and is slanted with respect to both of the surface direction and the thickness direction of the piezoelectric plate 11.

As described above, according to the present embodiment, the first electrode 12 is formed continuously over the entire surface of the piezoelectric plate 11, while the plurality of second electrodes 13 are provided for the plurality of ink chambers 24, respectively, so that each second electrode 13 extends over both of the polarized areas M1 and M2 in the corresponding operating part M. The second electrodes 13 can therefore apply driving voltages to the operating parts M independently from one another. However, the first electrode 12 can be divided into a plurality of electrode sections at positions coincident with the plurality of ink chambers 24. In terms of production, however, the first electrode 12 is preferably formed continuously over the surface of the piezoelectric plate 11. By merely providing only the electrodes 13 in one-to-one correspondence with the plurality of operating parts M, it is possible to arrange, in the piezoelectric plate 11, the plurality of actuating portions M so that the actuating portions M can be driven selectively and independently.

With the above-described configuration, the ink ejection device 1 performs ink ejecting operation as described with reference to FIGS. 1 through 3.

First, as shown in FIG. 1, ink is filled in the ink chambers 24. At this time, the first and second driving electrodes 12 and 13 are grounded (GND in FIG. 1).

Figure 2:
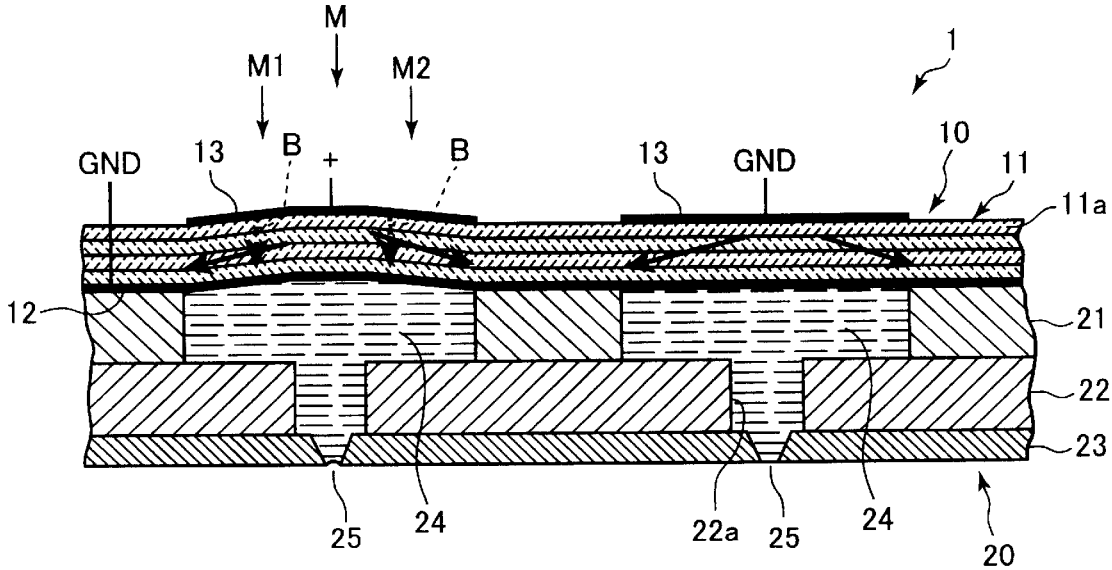
FIG. 2 is a cross-sectional view showing deforming state of the piezoelectric transducer according to the first embodiment.
Figure 3:
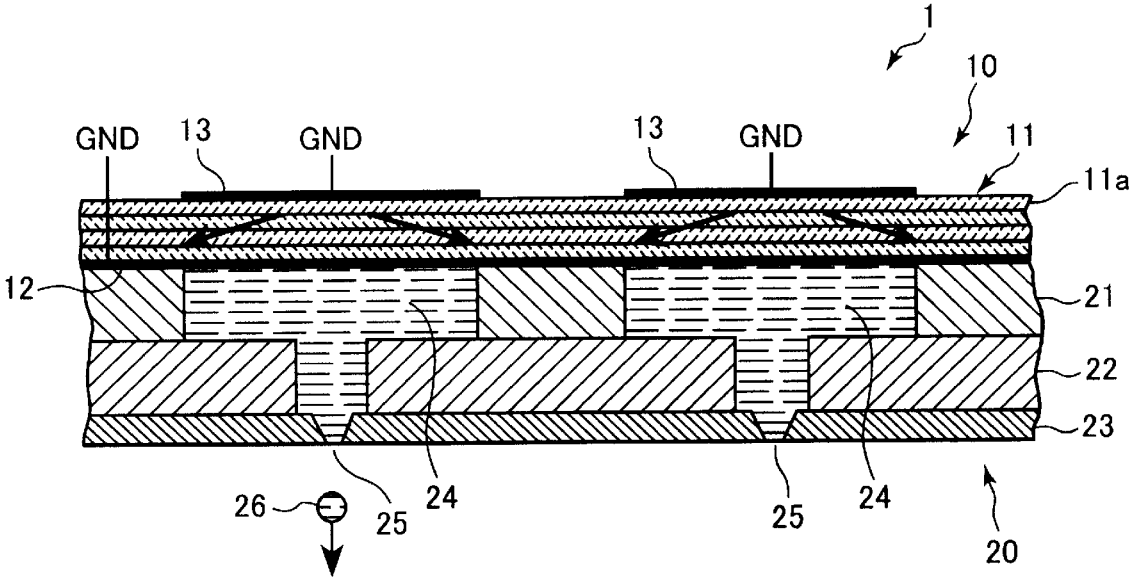
FIG. 3 is a cross-sectional view showing liquid ejection phase according to the first embodiment.

Next, as shown in FIG. 2, while the first electrode 12 is maintained as being grounded, a positive driving voltage (for example, 20V to 30V) is applied to one second driving electrode 13 that is located on an operating part M for a specific ink chamber 24, from which it is desired to eject ink. Upon application of the driving voltage, an electric field is generated in the operating part M between the first and second electrodes 12 and 13. As indicated by broken arrows B in FIG. 2, the electric field is directed along the thickness of the piezoelectric plate, that is, approximately perpendicular to the polarizing directions in both of the pair of polarized portions M1 and M2 in the operating part M. As a result, both of the polarized portions M1 and M2 are deformed in a shear mode fashion.

More specifically, the pair of polarized portions M1 and M2 are deformed symmetrically substantially with respect to the center of the corresponding ink chamber 24. Each polarized portion M1, M2 is symmetrically deformed into a parallelogram shape. As a result, the central region in the operating part M of the piezoelectric plate 11 is displaced toward a direction away from the ink chamber 24 in the direction perpendicular to the surface direction of the piezoelectric plate 11, thereby increasing the internal volume of the ink chamber 24. This deformed state is maintained for a period of time T, which is one-way propagation period of a pressure wave generated by the deformation. In accordance with the increase in the ink chamber volume, ink is supplied from the ink supply source (not shown) to the ink chamber 24. Incidentally, the one-way propagation period T is the time period during which the pressure wave in the ink chamber 24 is propagated through the longitudinal length (in a direction perpendicular to the sheet of FIG. 1, that is, in the direction perpendicular to the line X—X in FIG. 4) of the ink chamber 24. "T" is defined by the formula "T=L/a" wherein "L" stands for the longitudinal length of the ink chamber 24, and "a" stands for a sonic velocity through the ink in the ink chamber.

According to propagation theory of the pressure wave, when the period "T" has been elapsed from the start timing of application of the driving voltage, pressure in the ink chamber 24 becomes positive pressure from negative pressure. According to the present embodiment, as shown in FIG. 3, at the moment where the pressure is changed from its negative value to the positive value, the driving voltage to the second electrode 13 is changed to 0V, i.e., the second electrode 13 is grounded, while the first electrode is maintained grounded. As a result, the piezoelectric plate 11 restores its original linear flat shape shown in FIG. 1, and the positive pressure is applied to the ink in the ink chamber 24. The positive pressure obtained by the pressure wave propagation and additional positive pressure provided by the restoration of the shape of the piezoelectric plate 11 will provide a relatively high pressure in the ink adjacent to the nozzle 25. Consequently, ink in the ink chamber 24 is ejected out of the nozzle 25 as an ink droplet 26 as shown in FIG. 3.

A process for producing the ink ejection device 1 will next be described with reference to FIGS. 5 through 9.

Figure 5:
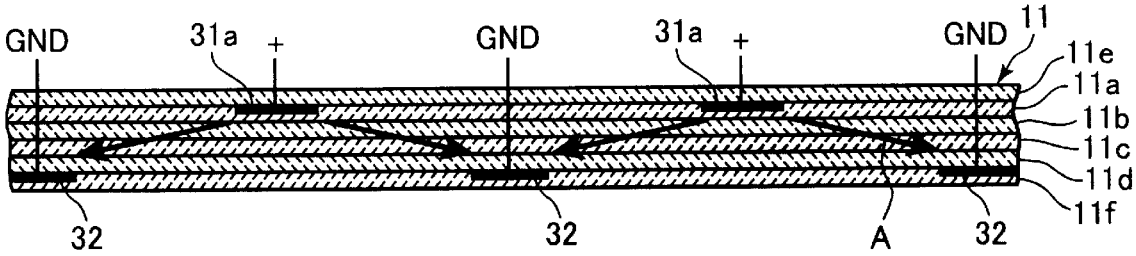
FIG. 5 is a cross-sectional view showing how a piezoelectric plate for the piezoelectric transducer according to the first embodiment is produced and polarized during the production process of the piezoelectric transducer.

As shown in FIG. 5, a green sheet stack is prepared to produce the piezoelectric plate 11. The green sheet stack includes four green sheets 11*a* through 11*d*, which are made from ceramic material and are stacked on one after another. An additional upper green sheet 11*e* is stacked on the green sheet stack, and an additional lower green sheet 11*f* is positioned below the green sheet stack. A common positive electrode 31 is interposed between the additional upper electrode 11*e* and the green sheet stack, and a common ground electrode 32 is interposed between the additional lower electrode 11*f* and the green sheet stack. Both of the common positive electrode 31 and the common ground electrode 32 are used for polarizing the green sheet stack.

Figure 6:
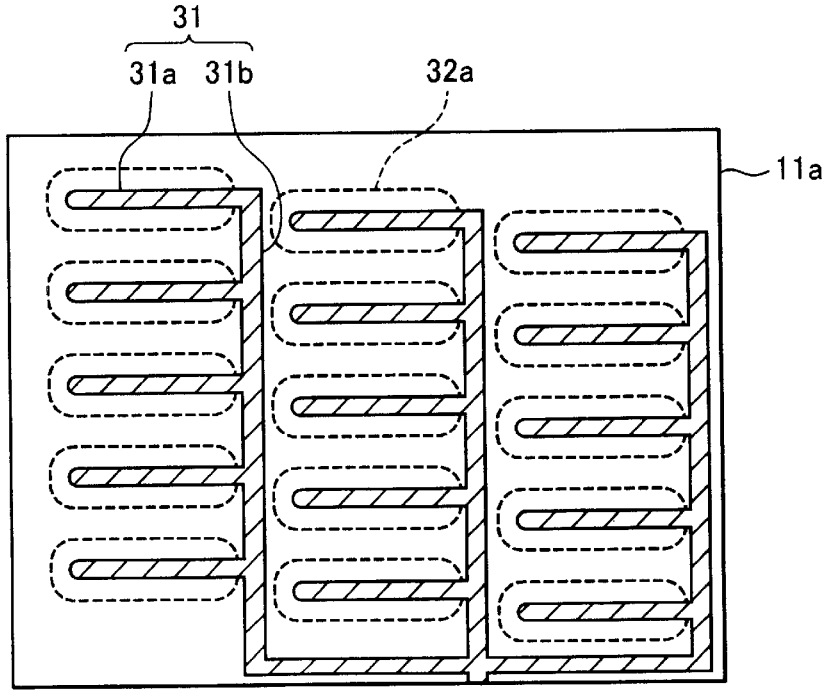
FIG. 6 is a plan view showing a polarizing common positive electrode formed on an upper surface of a second uppermost green sheet during the production process of the piezoelectric transducer.

More specifically, the common positive electrode 31 is formed on the green sheet 11*a* (second uppermost sheet of the resultant stack) as shown in FIG. 6. The common positive electrode 31 is formed by screen printing using electrically conductive paste, or by vapor deposition of the electrically conductive material. The common positive electrode 31 includes: a plurality of extension portions 31*a*, and a plurality of lead portions 31*b*. The extension portions 31*a* are provided at positions corresponding to the center portions of the ink chambers 24. The lead portions 31*b* are provided for connecting these extension portions 31*a* to one another and for leading these extension portions 31*a* to an edge of the green sheet 11*a*.

Figure 7:
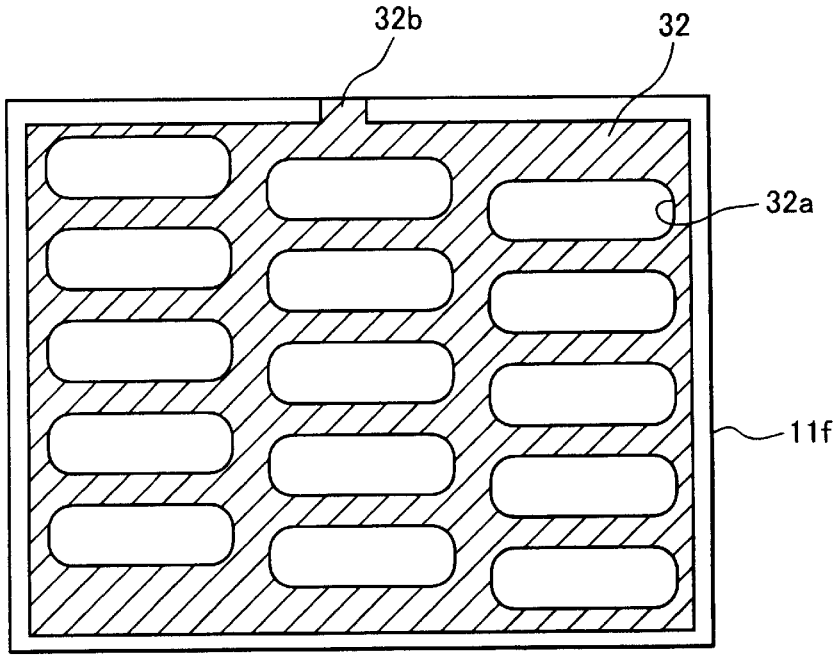
FIG. 7 is a plan view showing a polarizing common ground electrode formed on an upper surface of a lowermost green sheet during the production process of the piezoelectric transducer.

As shown in FIG. 7, the common ground electrode 32 is formed an the lowermost green sheet 11*f*, except for areas 32*a* that correspond to the ink chambers 24. A lead portion 32*b* is also formed on the lowermost green sheet 11*f* for leading the common ground electrode 32 to an edge of the green sheet 11*f*. The areas 32*a* will be referred to as openings 32*a* in the common ground electrode 32. The common electrode 32 and the lead portion 32*b* are formed by screen printing or vapor deposition in the same manner as the common positive electrode 31. The common positive electrode 31 and the common ground electrode 32 are made from Ag—Pd metal, and have thickness of about 0.002 mm.

The green sheet 11*e* formed with no electrodes, the green sheet 11*a* formed with the common positive electrode 31, the green sheets 11*b*–11*d* with no electrodes, and the green sheet 11*f* formed with the common ground electrode 32 are stacked one after another. Thereafter, the stack is baked for integration. Incidentally, FIG. 6 shows the positional relationship between the common positive electrode 31 and the openings 32*a* of the common ground electrode 32.

Next, the thus produced green sheet stack is dipped or immersed in an insulation oil, such as a silicone oil, with a temperature of 130° C. in an oil bath, and the common ground electrode 32 is connected to a ground GND through the lead portion 32*b*, whereas positive voltage is applied to the common positive electrode 31 through the lead portion 31*b*, so that electric fields with the amounts of about 2.5 kV/mm are generated between the extension portions 31*a* and the common ground electrode 32 in slanted directions with respect to both of the surface direction and the thickness direction of the green sheet stack. As a result, as shown in FIG. 5, the green sheet stack is polarized in the directions A.

Figure 8:
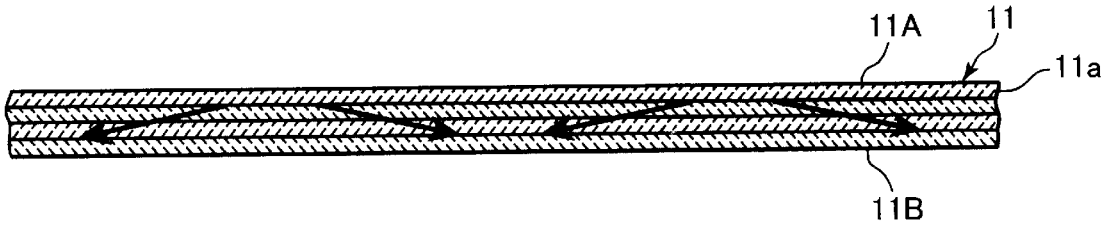
FIG. 8 is a cross-sectional view showing piezoelectric layers in a state where uppermost and lowermost layers of the piezoelectric plate and the polarizing electrodes are removed during the production process of the piezoelectric transducer.

Thereafter, as shown in FIG. 8, upper and lower surfaces of the green sheet stack are subjected to grinding operation to remove the uppermost and lowermost sheets 11*e* and 11*f* and the common positive electrode 31 and the common ground electrode 32 from the green sheet stack. As a result, ground surfaces 11A and 11B are provided on the green sheet stack.

Figure 9:
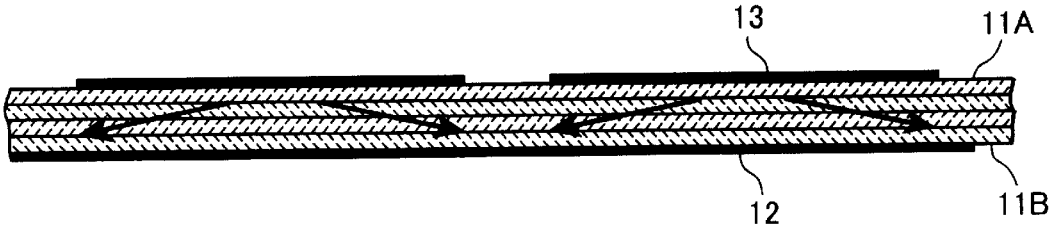
FIG. 9 is a cross-sectional view showing how first and second driving electrodes are provided to the piezoelectric layers of FIG. 8.

Then, as shown in FIG. 9, the first driving electrode 12 is formed over the entire surface of the ground surface 11B, and the second driving electrodes 13 are formed on the ground surface 11A at positions of the polarized portions corresponding to the ink chambers 24. These electrodes are formed by the screen printing or vapor deposition in the same manner as the common electrodes 31 and 32.

Next, the thus produced piezoelectric plate 11 (piezoelectric transducer 10) is joined to the ink chamber unit 20. It is noted that the ink chamber unit 20 is previously produced by stacking and joining together the ink chamber plate 21, the spacer plate 22, and the nozzle plate 23. As a result, the ink ejection device 1 is finally produced as shown in FIG. 1.

As described above, in the ink ejection device 1 according to the first embodiment, the common positive electrode 31 and the common ground electrode 32 are provided in the patterns common for the respective ink chambers 24, and the piezoelectric plate 11 is subjected to polarization by using the common electrodes 31 and 32. Therefore, simultaneous polarization can be conducted with respect to all the ink chambers without intricate polarizing operation.

Additionally, after the polarization, grinding is performed for removing the common electrodes 31 and 32 from the piezoelectric plate 11. Thus, no electrode for the purpose of polarization remains in the piezoelectric plate 11. Accordingly, a problem of cross-talk can be avoided.

Further, as described above, the polarizing direction is slanted with respect to the surface direction and the thickness direction of the piezoelectric plate 11. To achieve this polarization, the common electrodes 31 and 32 are formed adjacent to the upper and lower surfaces of the piezoelectric plate 11 in such a manner that these common electrodes 31 and 32 are not aligned in the thickness direction of the piezoelectric plate 11 (see hatching 31*a* and broken line 32*a* in FIG. 6). By providing the driving electrodes 12 and 13 at opposite surfaces of the piezoelectric plate 11 in a manner that the electrodes 13 are aligned with the electrode 12 in the thickness direction, driving electric field is directed in a direction substantially perpendicular to the slanted polarization directions as shown in FIG. 2. Consequently, efficient deformation of the piezoelectric plate 11 can be attained with a smaller number of electrodes 13.

As described above, according to the present embodiment, the piezoelectric plate 11 is polarized in directions slanted with respect to both of the thickness direction and the surface direction, at a pair of regions M1 and M2, which are defined between the center of each actuating portion M and the two non-actuating portions N that sandwich the actuating portion therebetween. With this configurations the piezoelectric plate 11 can effectively deform the entire part of each actuating portion M.

Because the piezoelectric plate 11 is produced by stacking, one on another, the plurality of piezoelectric sheets 11*a*–11*f* made of piezoelectric material, it is possible to enhance the strength of the entire piezoelectric plate 11.

In the present embodiment, by disposing the common electrodes 31 and 32 in the interior of the ceramic material lamination, it is possible to reduce occurrence of electric discharge during the polarization process. It is possible to polarize the ceramic lamination efficiently. However, these common electrodes can be formed at the outermost surfaces of the lamination. Alternatively, separate-type common electrodes can be placed in contact with the outermost surfaces of the lamination for the polarization.

Further, the polarity of the direct-current voltage, opposite to that applied in the present embodiment, can be applied between the common positive electrode 31 and the common ground electrode 32 so as to reverse the polarizing direction. Or, positions of the driving electrodes 12 and 13 can be replaced from each other so that driving voltage with opposite polarity will be applied between these driving electrodes 12 and 13. In both of these cases, when the driving voltage is applied between the driving electrodes 12 and 13, the internal volume of the ink chamber 24 will be reduced and eject ink therefrom.

Second Embodiment

An ink ejection device 101 according to a second embodiment of the present invention will next be described with reference to FIGS. 10 through 13, wherein like parts and components are designated by the same reference numerals as those of the first embodiment shown in FIGS. 1 through 9.

Figure 10:
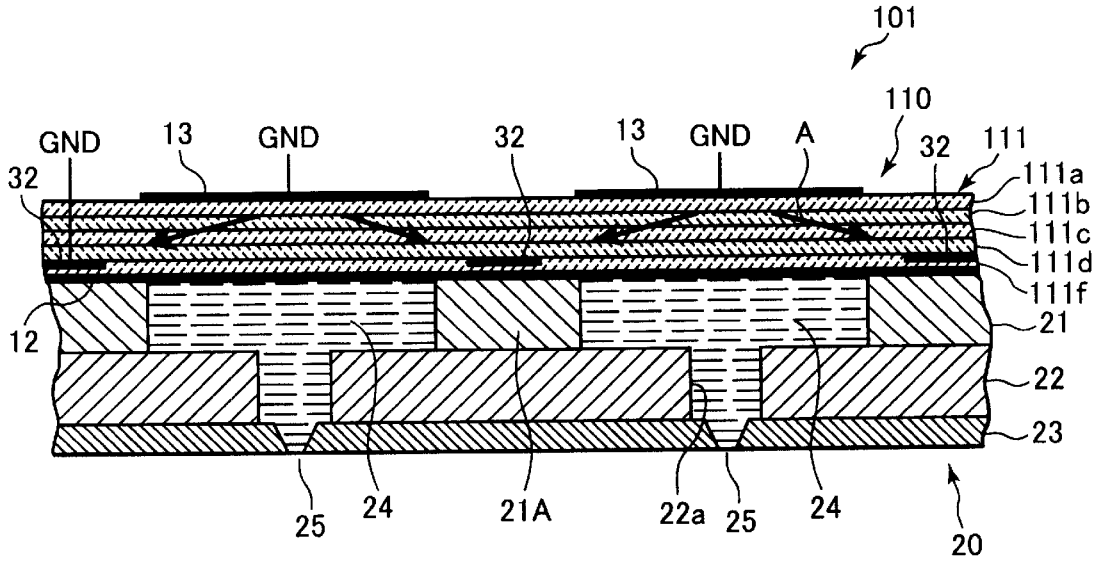
FIG. 10 is a cross-sectional view showing an ink ejection device that employs a piezoelectric transducer according to a second embodiment of the present invention.

As shown in FIG. 10, the ink ejection device 101 includes: a piezoelectric transducer 110 and the ink chamber unit 20. The ink chamber unit 20 has the same structure as the ink chamber unit 20 in the first embodiment. The piezoelectric transducer 110 is almost the same as the piezoelectric transducer 10 of the first embodiment except that a green sheet 111*f*, which is used during the polarization process, remains on a piezoelectric plate 111 that constitutes the piezoelectric transducer 110 and except that the common ground electrode 32, which is also used during the polarization process, remains in the interior of the piezoelectric plate 111. According to the present embodiment, therefore, the piezoelectric plate 111 includes sheet-like piezoelectric layers 111*a* through 111*d* and 111*f*, the first and second electrodes 12 and 13, and the common ground electrode 32 for polarization.

Because the common ground electrode 32 has the openings 32*a* as shown in FIG. 7 in one-to-one correspondence with the ink chambers 24 and therefore is not aligned with the ink chamber 24, the common ground electrode 32 does not impart any undesirable affection in respect of the cross-talk. The ink ejection device 101 of the second embodiment can therefore exhibit its performance approximately the same as that of the first embodiment.

Figure 11:
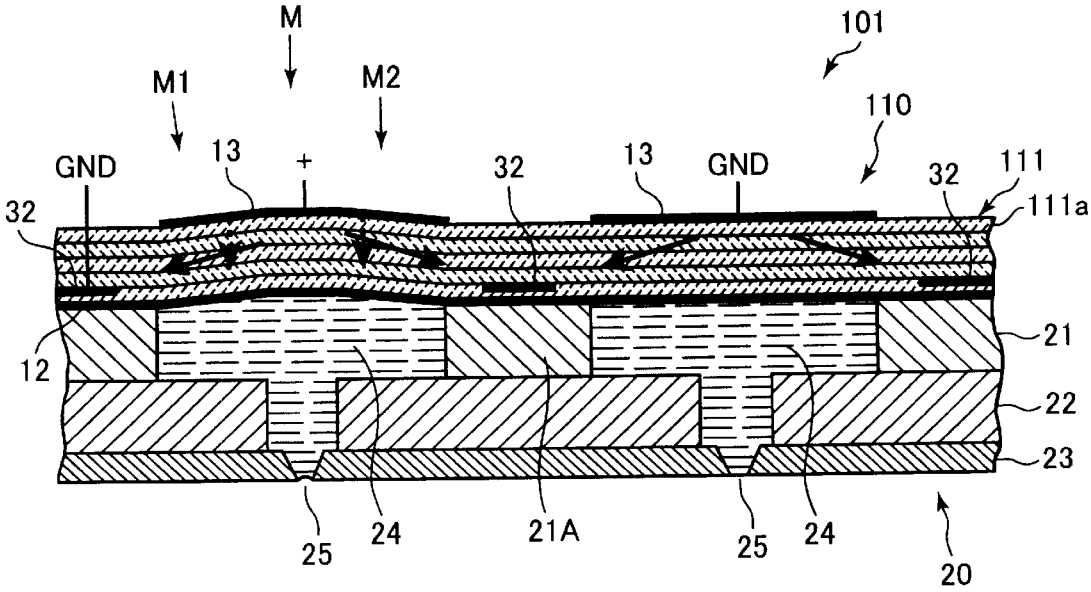
FIG. 11 is a cross-sectional view showing deforming state of the piezoelectric transducer according to the second embodiment.

In operation, similarly to the first embodiment, as shown in FIG. 11, a positive driving voltage is applied to some second driving electrode 13 that corresponds to a specific ink chamber 24, from which ink ejection is to be performed, while the first driving electrode 12 is grounded. Because the electric field generated between the first and second electrodes 12 and 13 is directed in a direction approximately perpendicular to the polarizing directions in the piezoelectric plate 111, the piezoelectric plate 111 is deformed in a shear mode fashion as shown in FIG. 11.

More specifically, in the operating part M of the piezoelectric plate 111, that is located below the energized electrode 13, the pair of polarized portions M1 and M2 are deformed symmetrically with respect to the center of the corresponding ink chamber 24. Each polarized portion M1, M2 is deformed into a parallelogramic shape. This deforming manner is the same as that of the first embodiment shown in FIG. 2.

Figure 12:
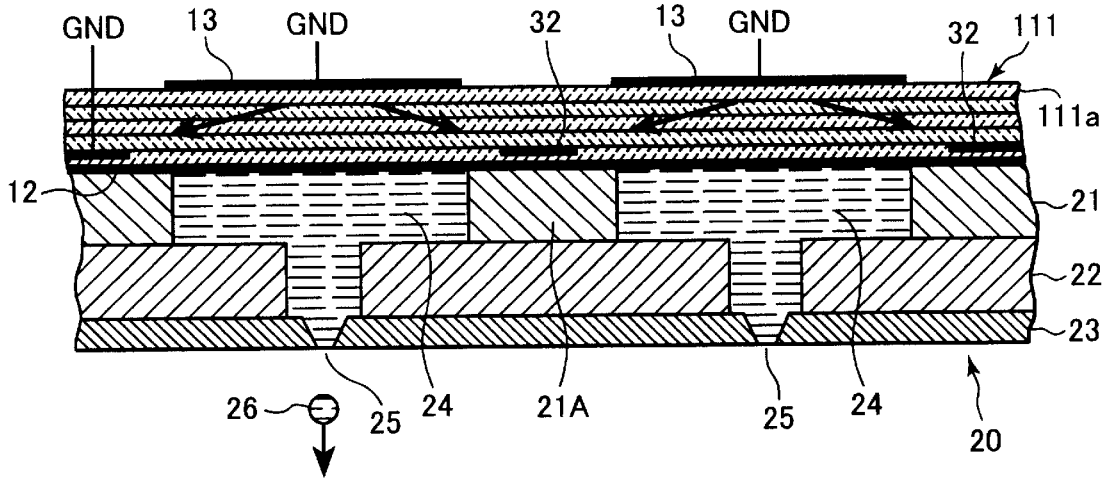
FIG. 12 is a cross-sectional view showing liquid ejection phase according to the second embodiment.

When the driving voltage to the second electrode 13 is changed back to 0V (ground voltage), while the first electrode 12 is maintained grounded, the piezoelectric plate 111 restores its original linear flat shape as shown in FIG. 12. Consequently, some amount of ink in the ink chamber 24 is ejected out of the nozzle 25 in the form of an ink droplet 26.

Process for producing the ink ejection device 101 according to the second embodiment is approximately the same as the process of the first embodiment.

More specifically, a green sheet 111*a* is formed with the common positive electrode 31 (not shown) similarly to the green sheet 11*a* in the first embodiment (FIGS. 5 and 6). A green sheet 111*f* is formed with the common ground electrode 32 similarly to the green sheet 11*f* in the first embodiment (FIGS. 5 and 7). Then, a green sheet 111*e* with no electrode, the green sheet 111*a* with the common positive electrode 31, green sheets 111*b*, 111*c*, and 111*d* with no electrodes, and the green sheet 111*f* with the common ground electrode 32 are stacked one on another in the same manner as the green sheets 11*e*, 11*a*, 11*b*–11*d*, and 11*f* in the first embodiment (FIG. 5). Thus, a green sheet stack is produced.

The green sheet stack is then baked together to produce the integrated lamination similar to that shown in FIG. 5. Direct-current voltage is applied between the common ground electrode 32 and the common positive electrode 31 so as to provide the pair of polarizations in the slanting directions at each operating portion M in the piezoelectric plate 111.

Figure 13:
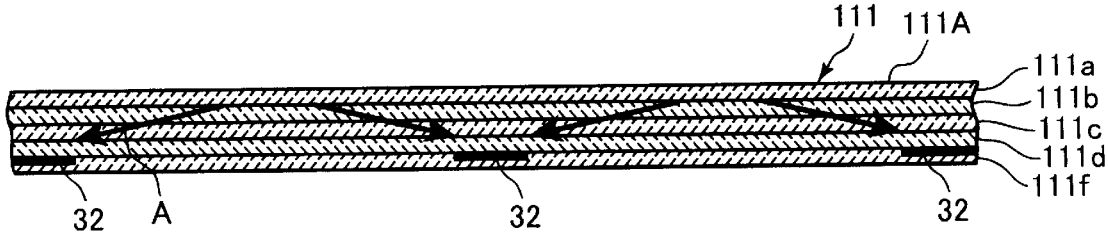
FIG. 13 is a cross-sectional view showing piezoelectric layers in a state where an uppermost layer of a piezoelectric plate and a polarizing common positive electrode is removed during the production process of the piezoelectric transducer according to the second embodiment.

Thereafter, the uppermost sheet 111*e* and the common positive electrode 31 are removed by grinding similarly to the first embodiment, in which the uppermost sheet 11*e* and the common positive electrode 31 are removed. On the other hand, the sheet 111*f* and the common ground electrode 12 are not removed, but maintained as shown in FIG. 13. Then, similarly to the first embodiment, the first driving electrode 12 and the second driving electrodes 13 are formed on the upper and lower surfaces, respectively, of the piezoelectric plate 111 as shown in FIG. 10, similarly to the manner, in which the electrodes 12 and 13 are formed in the first embodiment (FIG. 9).

Third Embodiment

An ink ejection device 201 having a piezoelectric transducer 210 according to a third embodiment of the present invention will be described with reference to FIGS. 14 through 22 wherein like parts and components are designated by the same reference numerals and characters as those shown in the foregoing embodiments.

Figure 14:
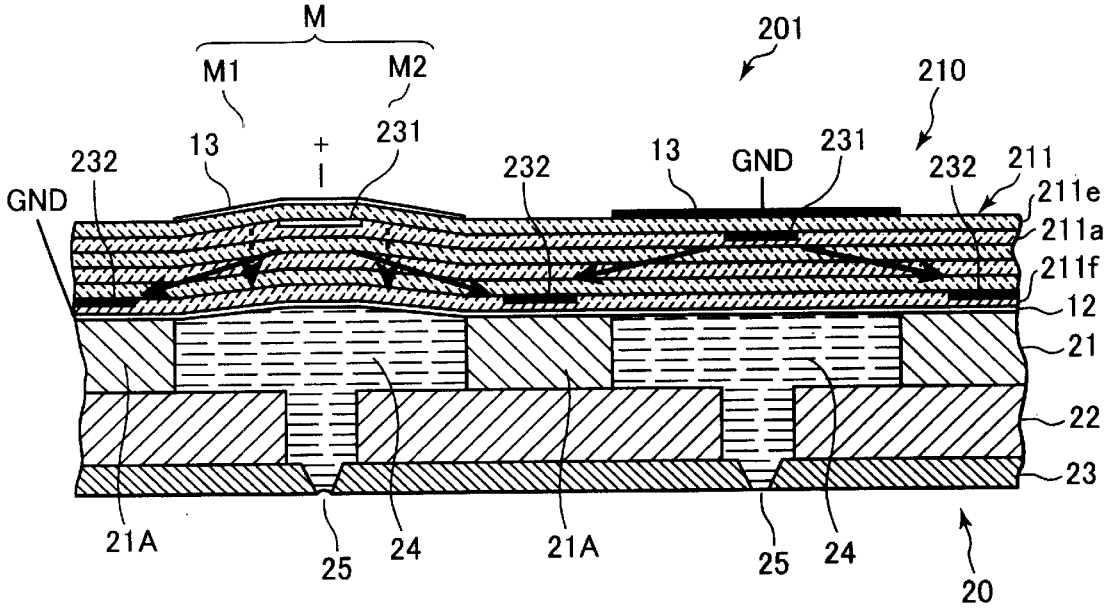
FIG. 14 is a cross-sectional view showing an ink ejection device that employs a piezoelectric transducer according to a third embodiment of the present invention and showing a deforming state of the piezoelectric transducer.

As shown in FIG. 14, the ink ejection device 201 includes: a piezoelectric transducer 210 and the ink chamber unit 20. The ink chamber unit 20 has the same configuration with the ink chamber unit 20 of the first embodiment.

The piezoelectric transducer 210 retains, in the interior of its constituent piezoelectric plate 211, a common positive electrode 231 and a common ground electrode 232, those being used for polarization. In this way, according to the present embodiment, the piezoelectric plate 211 includes: sheet like piezoelectric layers 211*e*, 211*a*, 211*b*, 211*c*, 211*d*, and 211*f* which are laminated one on another; the first and second driving electrodes 12 and 13; the common positive electrode 231, and the common ground electrode 232.

Figure 16:
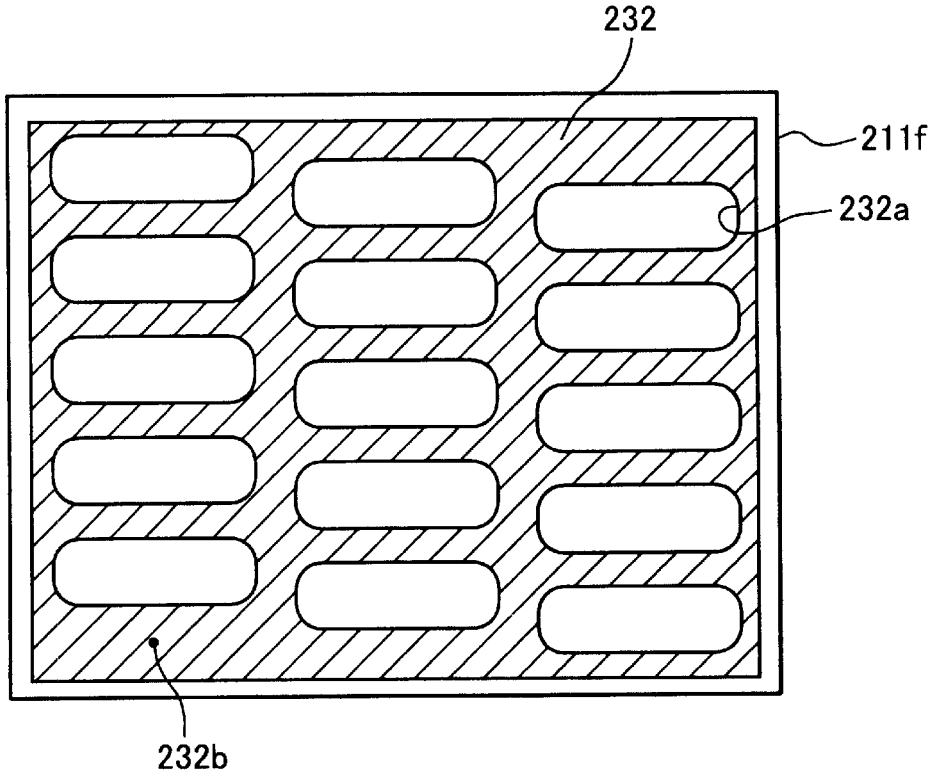
FIG. 16 is a plan view showing a polarizing common ground electrode formed on the lowermost green sheet during the production process of the piezoelectric transducer according to the third embodiment.

In order to produce the piezoelectric plate 211, green sheets 211*a*–211*f* are prepared. As shown in FIG. 16, the common ground electrode 232 is formed on the upper surface of the lowermost green sheet 211*f*. The common ground electrode 232 is formed on the green sheet 211*f* except for the opening areas 232*a*, that are arranged in one-to-one correspondence with the ink chambers 24, similarly to the common electrode 32 in the first embodiment (FIG. 7). According to the present embodiment, the common ground electrode 232 is formed with a lead part 232*b*. The lead part 232*b* extends through the thickness of the green sheet 211*f* so as to be exposed to the lower surface of the green sheet 211*f*. To provide the lead part 232*b*, before the common ground electrode 232 is formed on the green sheet 211*f*, the green sheet 211*f* is previously formed with a through-hole, and an electrically conductive paste is filled in the through-hole.

Figure 17:
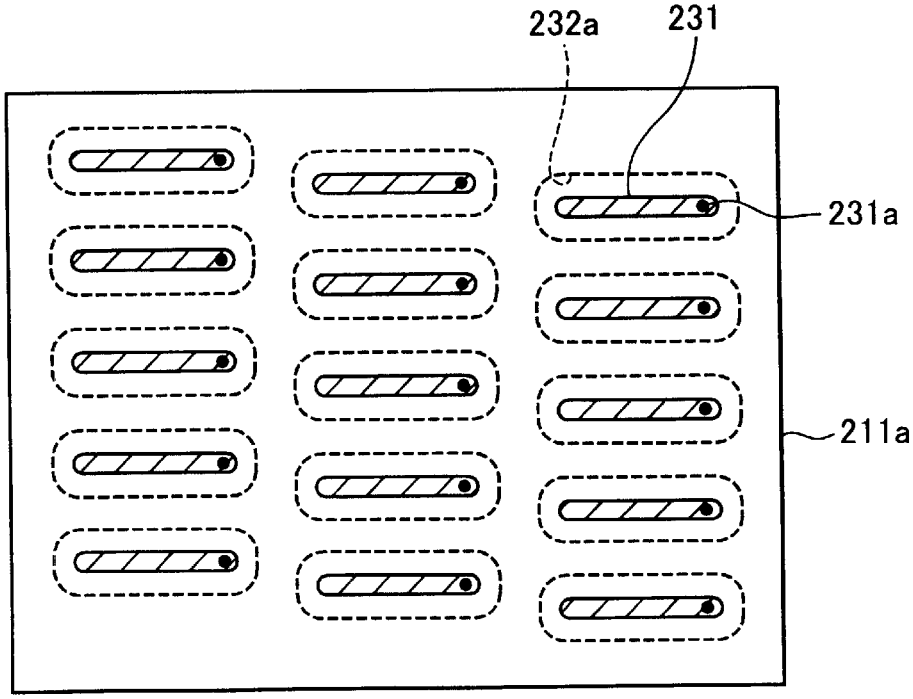
FIG. 17 is a plan view showing a polarizing common positive electrode formed on the second uppermost green sheet during the production process of the piezoelectric transducer according to the third embodiment.

As shown in FIG. 17, a plurality of common positive electrodes 231 are formed on the upper surface of the second uppermost green sheet 211*a*.

Figure 18:
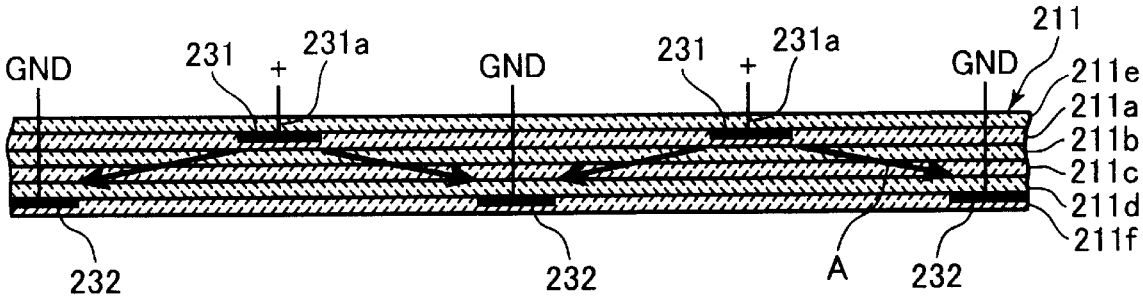
FIG. 18 is a cross-sectional view showing a piezoelectric lamination embedded with the polarizing common positive electrode and the polarizing common ground electrode during the production process of the piezoelectric transducer according to the third embodiment.

As shown in FIG. 18, a plurality of lead parts 231*a* are formed to penetrate through the uppermost green sheet 211*e*. Each lead part 231*a* extends from the upper surface of the green sheet 211*e* through the thickness of the green sheet 211*e* to be exposed on the lower surface of the green sheet 211*e*. The lead parts 231 are formed in the green sheet 211*e* at positions that an exposed end of each lead part 231*a* on the lower surface of the green sheet 211*e* is connected with a corresponding common positive electrode 231 as shown in FIG. 17.

In order to produce the lead parts 231*a* in the green sheet 211*e*, the green sheet 211*e* is formed with through-holes at positions corresponding to the common positive electrodes 231. An electrically conductive paste is filled in each through-hole to provide the lead part 231*a*.

The green sheet 211*e* formed with the lead parts 231*a*, the green sheet 211*a* formed with the electrodes 231, the green sheets 211*b*–211*d* formed with no electrodes, and the green sheet 211*f* formed with the electrode 232 and the lead part 232*b* are stacked one on another, and the green sheet stack is baked to provide the piezoelectric plate 211 shown in FIG. 18.

Figure 19:
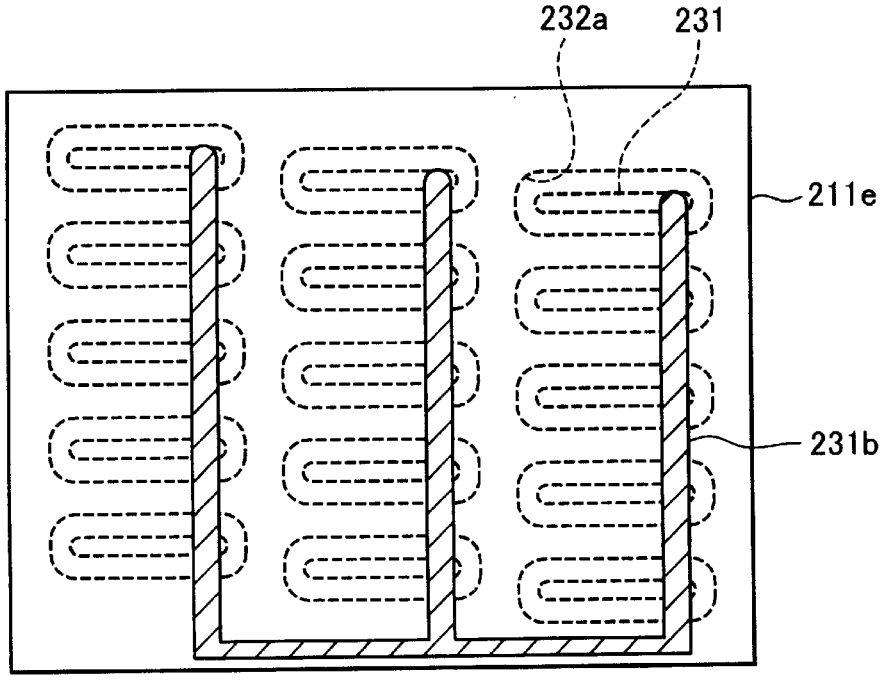
FIG. 19 is a plan view showing a lead electrode for the common positive electrode, provided on the uppermost surface of the piezoelectric plate according to the third embodiment.

Thereafter, as shown in FIG. 19, a lead electrode 231*b* is formed over the upper surface of the piezoelectric plate 211 (upper surface of the uppermost sheet 211*e*) in order to interconnect the lead parts 231*a* with one another. Another lead electrode (not shown) is formed on the lower surface of the piezoelectric plate 211 (lower surface of the lowermost sheet 211*f*) in order to be connected with the lead part 232*b* (FIG. 16).

Figure 20:
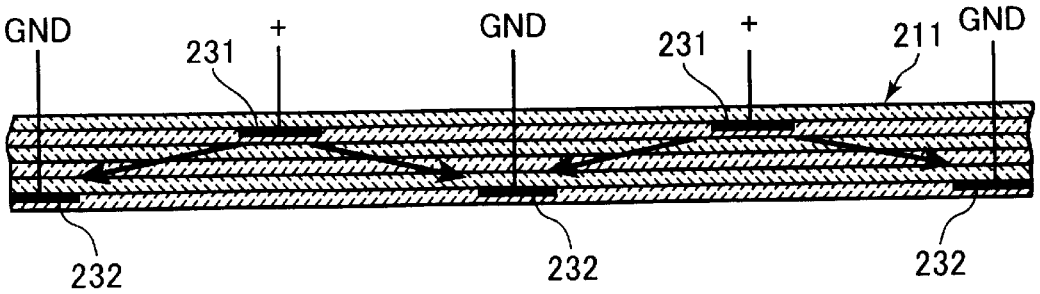
FIG. 20 is a cross-sectional view showing how the piezoelectric plate is polarized during the polarization process according to the third embodiment.

Then, as shown in FIG. 20, the electrode 232 is connected to a ground (GND) through the lead part 232*b* and the lead electrode (not shown). All the electrodes 231 are applied with a positive voltage through the lead parts 231*a* and the lead electrode 231*b*. As a result, the piezoelectric plate 211 is subjected to polarization in directions of imaginary lines that connect the electrodes 231 with the electrode 232, that is, in slanted directions with respect to both the surface direction and the thickness direction of the piezoelectric plate 211.

Figure 21:
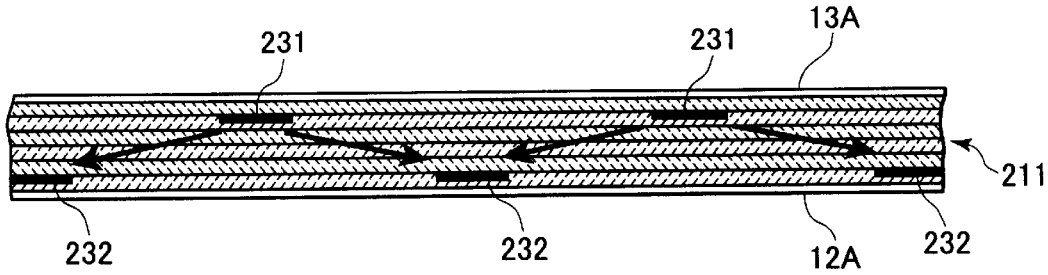
FIG. 21 is a cross-sectional view showing a state where electrode layers are formed on opposite surfaces of the piezoelectric plate during the process for producing the piezoelectric transducer according to the third embodiment.

Then, as shown in FIG. 21, the upper and lower surfaces of the piezoelectric plate 211 are entirely formed with electrode layers 13A and 12A, respectively, by screen printing or by vapor deposition.

Figure 22:
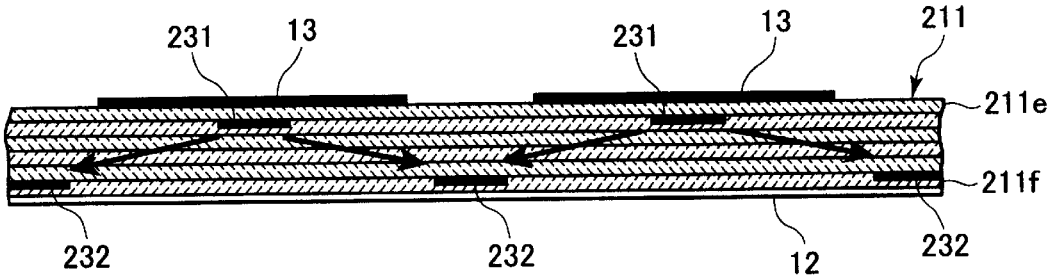
FIG. 22 is a cross-sectional view showing a state where electrode layers are partially removed during the process for producing the piezoelectric transducer according to the third embodiment.

Then, as shown in FIG. 22, the electrode layer 13A is partly removed by using a laser beam to provide the plurality of second driving electrodes 13. More specifically, parts of the electrode layer 13A are removed at positions corresponding to the partition walls 21A (shown in FIG. 14). As a result, the electrode layer 13A is divided into the plurality of second driving electrodes 13 in one to one correspondence with the plurality of liquid chambers 24.

Although the electrode layer 12A may be divided into plural electrodes 12 in one-to-one correspondence with the plurality of liquid chambers 24 similarly to the electrode layer 13A. However, it is preferable not to divide the electrode layer 12A into the plural electrodes. It is preferable to retain the electrode layer 12A as it is and to use the electrode layer 12A as the first electrode 12 that covers all the liquid chambers 24.

When dividing the electrode layer 13A into the second electrodes 13, portions of the electrode layer 13A, around the lead parts 231*a* and the lead electrode 231*b* on the uppermost layer 211*e*, are also removed in order to electrically isolate the second electrodes 13 from the electrodes 231. Similarly, a portion of the electrode layer 12A, around the lead part 232*b* on the lower surface of the lowermost layer 211*f*, is removed in order to electrically isolate the electrode 12 from the electrode 232.

Ink ejecting operation in the third embodiment is substantially the same as that of the first embodiment.

As shown in FIG. 14, a positive driving voltage is applied to some second driving electrode 13 that correspond to a specific ink chamber 24, from which ink ejection is to be performed, while the first driving electrode 12 is grounded. Because electric field generated between the first and second electrodes 12 and 13 is directed in a direction approximately perpendicular to the polarizing directions in the piezoelectric plate 211, the piezoelectric plate 211 is deformed in a shear mode fashion as shown in FIG. 14. That is, the pair of polarized portions M1 and M2 in the operating part M of the piezoelectric plate 211 are symmetrically deformed with respect to the center of the corresponding ink chamber 24. Each polarized portion M1, M2 is deformed into a parallelogram shape.

Figure 15:
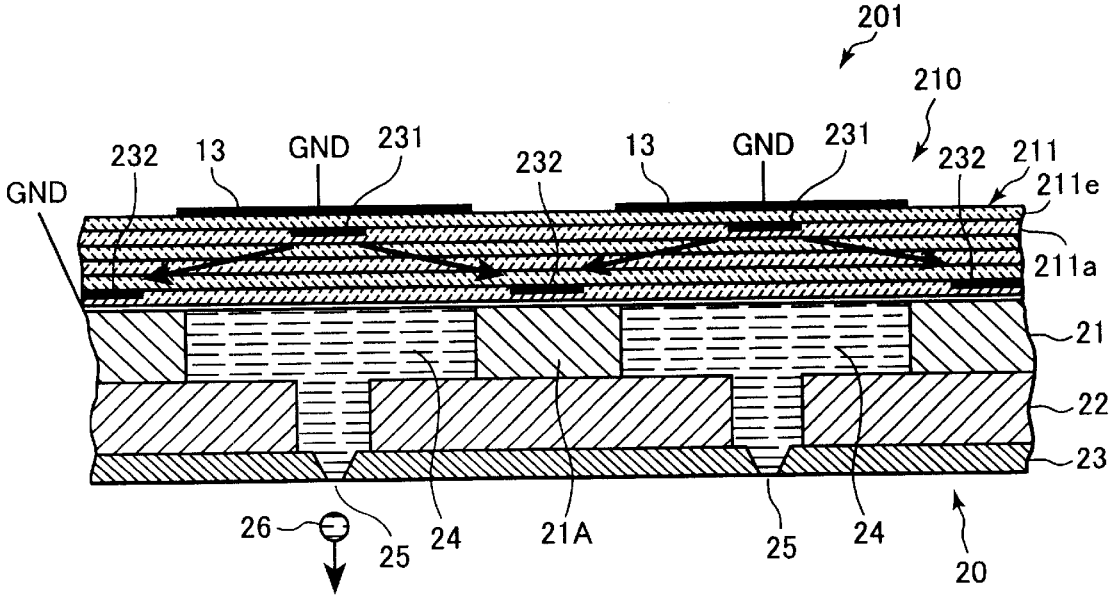
FIG. 15 is a cross-sectional view showing an ink ejection phase of the piezoelectric transducer according to the third embodiment.

When the driving voltage to the second electrode 13 is changed back to 0 V (ground voltage), while the first electrode 12 is maintained grounded, the piezoelectric plate 211 restores its original linear flat shape as shown in FIG. 15. Consequently, a predetermined amount of ink is ejected in the form of an ink droplet 26 through the nozzle 25 from the ink chamber 24.

As described already, the electrodes 13 are separated from one another and are separated from the internal polarizing electrodes 231 by removing the portions of the electrode layer 13A around the lead parts 231*a* and around the lead electrode 231*b*. The electrode 12 is separated from the internal polarizing electrodes 232 by removing the portion of the electrode layer 12A around the lead part 232*b*. Accordingly, it is still possible to prevent the driving operation at some ink chamber 24 from affecting to its neighboring ink chambers 24, thereby preventing the cross-talk.

In the third embodiment, formation of the leading electrode 231*b* for the internal electrodes 231 is executed on the uppermost layer 211*e* separately from the formation of the electrode layer 13A. Similarly, formation of the leading electrode (not shown) for the internal electrode 232 is executed on the uppermost layer 211*e* separately from the formation of the electrode layer 12A.

However, the process for forming the leading electrodes for the internal electrodes 232 and 231 can be eliminated, and the electrode layers 12A and 13A can be used also as the leading electrodes for the internal electrodes 232 and 231. This can reduce the number of production steps. However, special attention should be drawn to a configuration and shape of the electrode layers 12A and 13A so that electric field of a sufficient strength can be generated for polarization and so that suitable first and second electrodes 12 and 13 can be provided by division of the electrode layer 12A and 13A into a plurality of sections.

In the present embodiment, when producing the electrodes 13, portions of the electrode layer 13A, around the lead parts 231*a* and the lead electrode 231*b*, are removed to electrically isolate the second electrodes 13 from the electrodes 231. Similarly, a portion of the electrode layer 12A, around the lead part 232*b*, is removed in order to electrically isolate the electrode 12 from the electrode 232. However, the second electrodes 13 can be maintained as being electrically connected to the internal electrodes 231 via the lead parts 231*a* and the lead electrode 231*b*. Similarly, the first electrode 12 can be maintained as being electrically connected to the internal electrode 232 through the lead part 232*b*. In this modification, the first electrode 12 becomes equi-potential with the internal electrode 232, and the second electrodes 13 become equi-potential with the internal electrodes 231.

Fourth Embodiment

An ink ejection device 301 according to a fourth embodiment of the present invention will be described with reference to FIGS. 23 and 24 wherein like parts and components are designated by the same reference numerals and characters as those shown in the foregoing embodiments.

Figure 23:
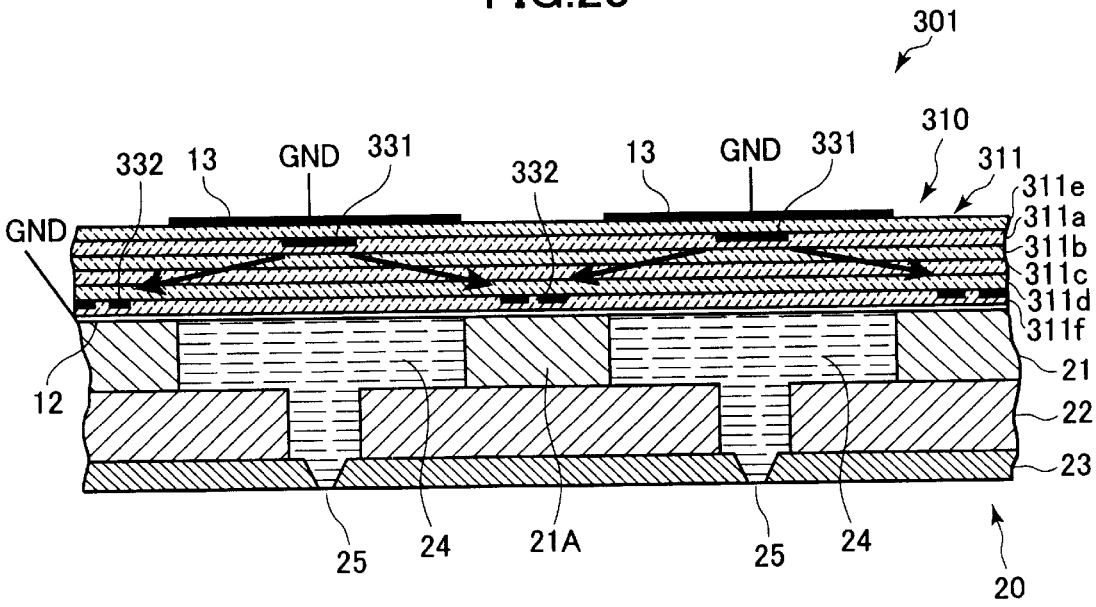
FIG. 23 is a cross-sectional view showing an ink ejection device that employs a piezoelectric transducer according to a fourth embodiment of the present invention.

As shown in FIG. 23, the ink ejection device 301 includes: a piezoelectric transducer 310 and the ink chamber unit 20. The ink chamber unit 20 has the same configuration with the ink chamber unit 20 of the first embodiment.

Figure 24:
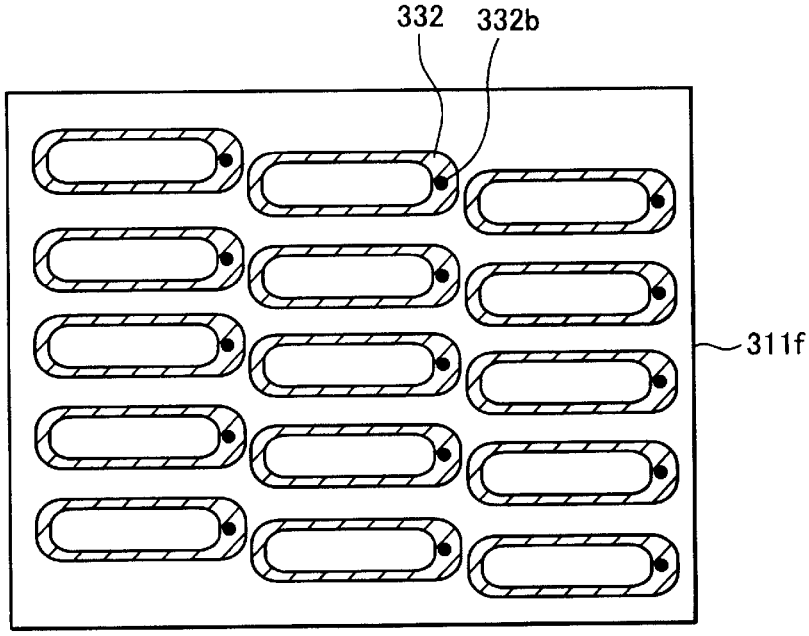
FIG. 24 is a plane view showing polarizing ring-shaped ground electrodes, provided on a lowermost piezoelectric layer, according to the fourth embodiment.

The structure of the piezoelectric transducer 310 of the present embodiment is the same as that of the piezoelectric transducer 210 of the third embodiment, shown in FIG. 14, except that a plurality of ground electrodes 332 are provided in correspondence with the plurality of ink chambers 24 as shown in FIG. 24 instead of the common electrode 232 shown in FIG. 16.

In this way, according to the present embodiment, a piezoelectric plate 311, constituting the piezoelectric transducer 310, includes: sheet-like piezoelectric layers 311*e*, 311*a*, 311*b*, 311*c*, 311*d*, and 311*f*; the first and second electrodes 12 and 13; common positive electrodes 331, and the ground electrodes 332. The common positive electrodes 331 are provided on the second uppermost layer 311*a*. The common positive electrodes 331 and their electrical connection are the same as the common positive electrodes 231 and their electrical connection in the third embodiment shown in FIGS. 17 and 19.

On the other hand, the ground electrodes 332 are provided on the upper surface of the lowermost layer 311*f* as shown in FIG. 24. Each ground electrode 332 is of a ring shape that surrounds a corresponding liquid chamber 24. A lead part 332*b* is formed extending from each ring-shaped electrode 332 to penetrate through the lowermost layer 311*f* and to be exposed on the lower surface of the lowermost layer 311*f*. In order to produce the lead parts 332*b* in the lowermost layer 311*f*, the green sheet for the lowermost layer 311*f* is formed with a plurality of through-holes (not shown) each corresponding to each ring-shaped ground electrode 332, and a lead part 332*b* is formed through the corresponding through-hole. A lead electrode (not shown) is provided on the lower surface of the green sheet 311*f* in electrical connection with all the lead parts 332*b*, thereby connecting all the electrodes 332 together.

In order to produce the piezoelectric transducer 310, the common positive electrodes 331 are provided on the second uppermost green sheet 311*a* in the same manner that the common positive electrodes 231 are provided on the second uppermost green sheet 211*a* in the third embodiment. The lead parts for the electrodes 231 are formed through the uppermost green sheet 311*e* in the same manner that the lead parts 231*a* are formed through the uppermost green sheet 231*e* in the third embodiment. The ground electrodes 332 are provided on the lowermost green sheet 311*f*, and the lead parts 332*b* are formed through the green sheet 311*f*. Then, the green sheet 311*e* with the lead parts, the green sheet 311*a* with the electrodes 331, the green sheets 311*b*–311*d* with no electrodes, and the green sheet 311*f* with the electrodes 332 and the lead parts 332*b*, are stacked one on another in the same manner that the green sheet 211*e* with the lead parts 231*a*, the green sheet 211*a* with the electrodes 231, the green sheets 211*b*–211*d* with no electrodes, and the green sheet 211*f* with the electrodes 232 and the lead part 232*b*, are stacked one on another in the third embodiment. The thus produced stack is baked to produce the piezoelectric plate 311 in the same manner as in the third embodiment. Then, a lead electrode is provided on the upper surface of the piezoelectric plate 311 in the same manner that the lead electrode 231*b* is provided on the piezoelectric plate 211 in the third embodiment. Another lead electrode is provided on the lower surface of piezoelectric plate 311 in electrical connection with all the lead parts 332*b*.

Then, during a polarization process for polarizing the piezoelectric plate 311, the ground electrodes 332 are connected to a ground by way of the lead electrode and the lead parts 332*b* in the same manner that the electrode 232 is grounded in the third embodiment.

Then, in the same manner as in the third embodiment, the driving electrodes 12 and 13 are provided on the piezoelectric plate 311.

The ink ejection device 301 of the present embodiment operates in the same manner as the ink ejection device 201 of the third embodiment.

Fifth Embodiment

Figure 25:
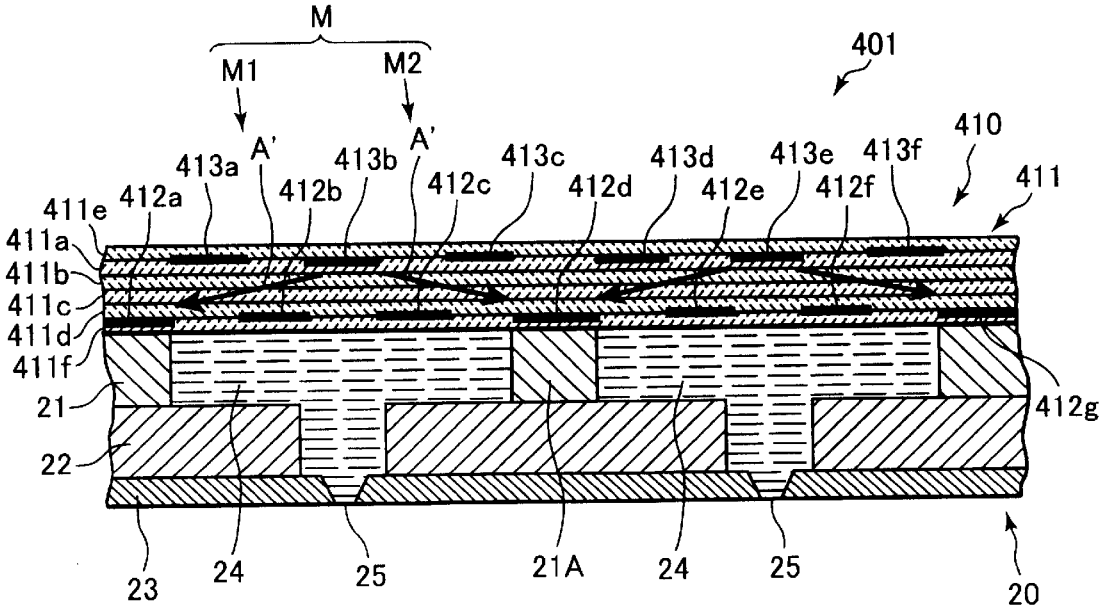
FIG. 25 is a cross-sectional view showing an ink ejection device that employs a piezoelectric transducer according to a fifth embodiment of the present invention.

An ink ejection device 401 according to a fifth embodiment of the present invention will be described with reference to FIGS. 25 through 30 wherein like parts and components are designated by the same reference numerals and characters as those shown in the foregoing embodiments As shown in FIG. 25, the ink ejection device 401 includes: a piezoelectric transducer 410 and the ink chamber unit 20. The ink chamber unit 20 has the same configuration with the ink chamber unit 20 of the first embodiment.

According to the present embodiment, the piezoelectric transducer 410 includes a piezoelectric plate 411. The piezoelectric plate 411 includes: sheet like piezoelectric layers 411*a* through 411*f*, and a plurality of internal first electrodes 413*a*–413*f* (which are referred to as first electrodes 413" as a whole), and a plurality of internal second electrodes 412*a*–412*f* (which are referred to as "second electrodes 412" as a whole). The first electrodes 413 are interposed between the uppermost piezoelectric layer 411*f* and the second uppermost piezoelectric layer 411*a*, and the second electrodes 412 are interposed between the lowermost piezoelectric layer 411*f* and the second lowermost piezoelectric layer 411*d*.

All the first internal electrodes 413 are arranged in the surface direction of the piezoelectric plate 411, and all the second internal electrodes 412 are arranged in the surface direction of the piezoelectric plate 411. The first internal electrodes 413 are arranged as being separated from one another in the surface direction. Similarly, the second internal electrodes 412 are arranged as being separated from one another in the surface direction. The first and second internal electrodes 413 and 412 are arranged in a staggered relationship. In other words, the first and second electrodes 413 and 412 are not in alignment with each other in the thickness direction of the piezoelectric plate 411, but are slightly offset from each other in the surface direction.

More specifically, the electrodes 413*a*, 413*b*, and 413*c* are arranged at positions in correspondence with one ink chamber 24. The electrodes 413*d*, 413*e*, and 413*f* are arranged at positions in correspondence with another ink chamber 24. The electrode 413*b* (which will be referred to as "first center electrode 413*b*") is positioned in alignment with the lateral center of the corresponding ink chamber 24 (center of the ink chamber 24 in the leftward/rightward direction of FIG. 25). Similarly, the electrode 413*e* (which will be referred also to as "first center electrode 413*e*") is positioned in alignment with the lateral center of the corresponding ink chamber 24 (center of the ink chamber 24 in the leftward/rightward direction of FIG. 25). Two electrodes 413*c* and 413*d* are positioned between the electrodes 413*b* and 413*e*. In other words, between the two first center electrodes, there are located two other internal first electrodes.

Each of the electrodes 412*a*, 412*d*, 412*g* (which will be referred to as "partition electrodes 412*a*, 412*d*, 412*g*") is positioned in alignment with a corresponding partition wall 21A. Two second electrodes 412*b* and 412*c* are positioned between the partition electrodes 412*a* and 412*d*, and therefore positioned in correspondence with one ink chamber 24. Two second electrodes 412*e* and 412*f* are positioned between the partition electrodes 412*d* and 412*g*, and therefore positioned in correspondence with another ink chamber 24.

In this way, according to the present embodiment, the operating part M for one ink chamber 24 is defined as the region where the electrodes 413*a*–413*c* are located, and the operating part M for another ink chamber 24 is defined at the region where the electrodes 413*d*–413*f* are located. For the first center electrode 413*b*, two first electrodes 413*a* and 413*b* are located neighboring to the electrode 413*b* in the surface direction, and two second electrodes 412*b* and 412*c* are located neighboring to the electrode 413*b* in the thickness direction. Similarly, for the other first center electrode 413*e*, two first electrodes 413*d* and 413*f* are located neighboring to the electrode 413*e* in the surface direction, and two second electrodes 412*e* and 412*f* are located neighboring to the electrode 413*e* in the thickness direction.

For the first electrode 413*a*, two second electrodes 412*a* and 412*b* are located neighboring to the electrode 413*a* in the thickness direction. For the first electrode 413*c*, two second electrodes 412*c* and 412*d* are located neighboring to the electrode 413*c* in the thickness direction. Similarly, for the first electrode 413*d*, two second electrodes 412*d* and 412*e* are located neighboring to the electrode 413*d* in the thickness direction. Similarly, for the first electrode 413*f*, two second electrodes 412*f* and 412*g* are located neighboring to the electrode 413*f* in the thickness direction.

The piezoelectric plate 411 is polarized in directions shown by arrows A', that is, in directions from the electrode 413*b* toward the electrodes 412*a* and 412*d* and in directions from the electrode 413*e* toward the electrodes 412*d* and 412*g*. Each of these directions is oblique with respect to both of the surface direction and the thickness direction of the piezoelectric plate 411.

Next, a process for producing the piezoelectric transducer 410 will be described.

Figure 26:
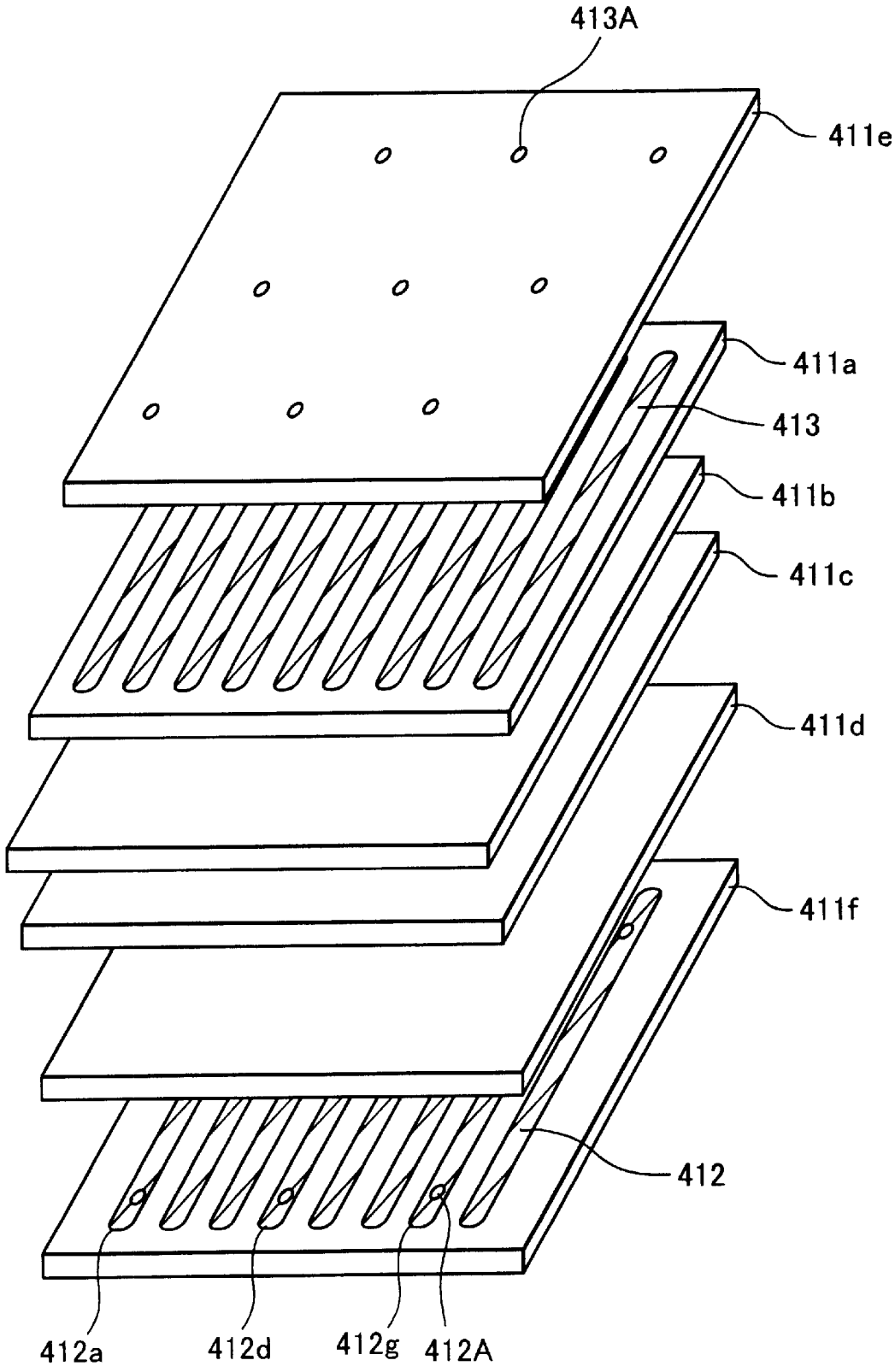
FIG. 26 is an exploded perspective view showing components of the piezoelectric transducer according to the fifth embodiment for description of a process for producing the transducer.

As shown in FIG. 26, a plurality of internal second electrodes 412 (second electrodes 412*a*–412*g*, and so on) are formed on an upper surface of the lowermost green sheet 411*f* by screen printing or vapor deposition. Each internal second electrode 412 is connected to a corresponding lead part 412A, which extends through the thickness of the green sheet 411*f* and is exposed on the lower surface of the green sheet 411*f*. Lead parts 412A of the partition electrodes 412*a*, 412*d*, 412*g* are positioned at one longitudinal end of the second electrodes 412, and lead parts 412 of the electrodes 412 other than the partition electrodes (that is, electrodes 412*b*, 412*c*, 412*e*, 412*f*) are positioned at another longitudinal end of the second electrodes 412.

Other green sheets 411*d*, 411*c*, 411*b*, which are not formed with electrodes, are stacked on the lowermost green sheet 411*f*. Then, the green sheet 411*a*, on which the plurality of internal first electrodes 413 are formed by screen printing or vapor deposition, is formed on the green sheet stack. Lead parts 413A, each connected to a corresponding internal first electrode 413, are formed in the uppermost green sheet 411*e*. These lead parts 413A extend through the thickness of the uppermost green sheet 411*e* and are exposed on both the upper and lower surfaces of the green sheet 411*e*. The green sheet 411*e* is stacked on the green sheet 411*a*, upon which the lead parts 413A are connected to the first electrodes 413.

Thereafter, the entire green sheet stack is heated, pressed, degreased, and baked to provide the integral piezoelectric transducer 410 (integral piezoelectric plate 411).

Figure 27:
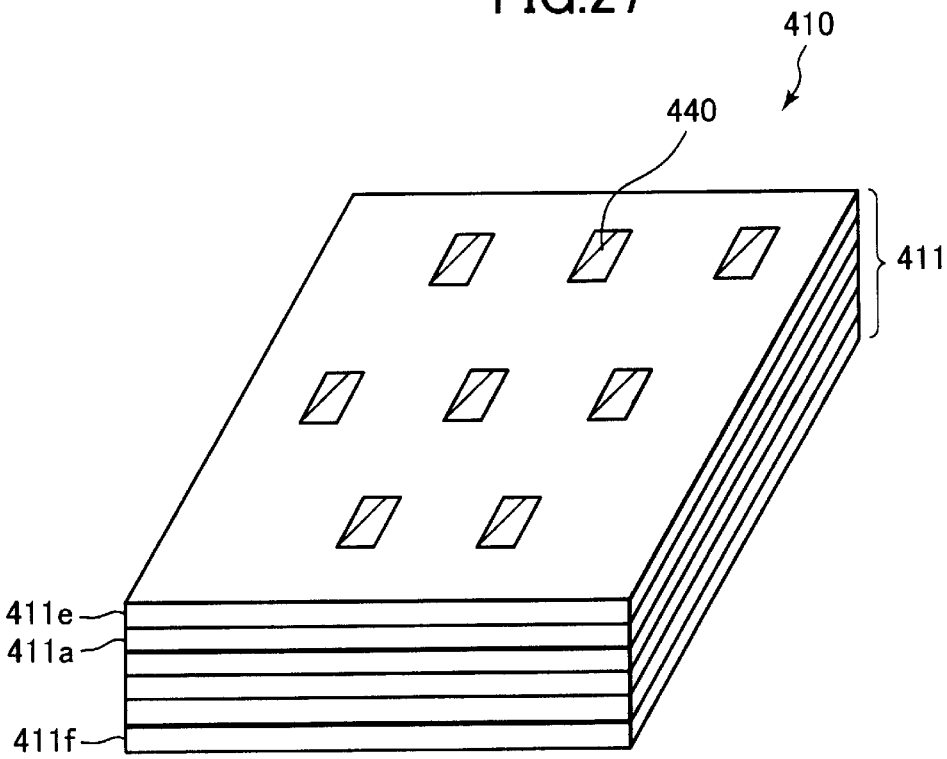
FIG. 27 is a perspective view showing external electrodes formed over the piezoelectric transducer in the fifth embodiment.

Next, as shown in FIG. 27, a plurality of first external electrodes 440 are provided at the upper surface of the piezoelectric plate 411. These external electrodes 440 are connected to the plurality of the internal first electrodes 413 through the plurality of lead parts 413A which are exposed on the upper surface. A plurality of second external electrodes (not shown) are provided at the lower surface of the piezoelectric plate 411. These external electrodes are connected to the internal second electrodes 412 through the plurality of lead parts 412A which are exposed to the lower surface. These external electrodes are made from a silver paste, and are formed independently for the respective lead parts by printing, baking, or spattering method.

Figure 28:
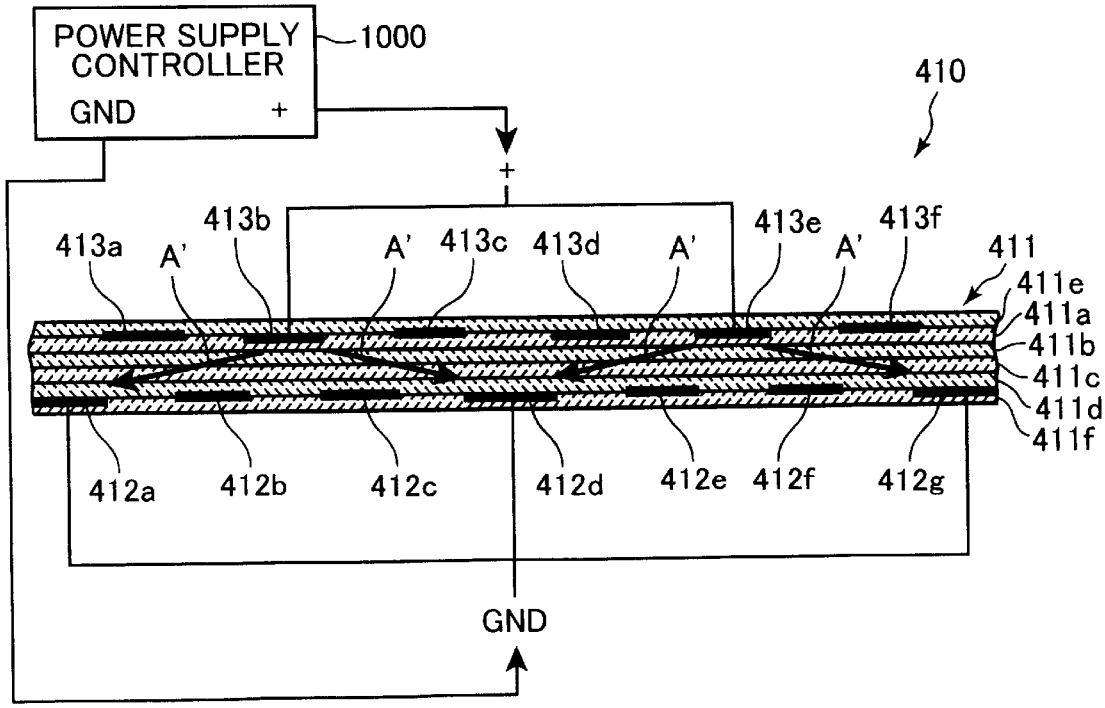
FIG. 28 is a cross-sectional view showing how a piezoelectric plate polarized during the production process of the piezoelectric transducer in the fifth embodiment.

The piezoelectric transducer 410 is then subjected to the polarization processing. That is, as shown in FIG. 28, a positive voltage is applied from a power supply controller 1000 to some first external electrodes 440 that are connected to the center internal first electrodes 413*b*, 413*e*. As a result, the positive voltage is applied to the center internal first electrodes 413*b*, 413*e* by way of their lead parts 413A. Some second external electrodes (not shown) which are connected to the second internal partition electrodes 412*a*, 412*d*, 412*g*, are grounded by the power supply controller 1000. As a result, the second partition electrodes 412*a*, 412*d*, 412*g* are grounded through their lead parts 412A. On the other hand, no electrical connection is provided with respect to the remaining internal electrodes, that is, internal electrodes 413*a*, 413*c*, 413*d*, 413*f*, 412*b*, 412*c*, 412*e*, 412*f*. Accordingly, as shown in FIG. 28, polarization occurs in the directions indicated by the arrows A' between the electrode 413*b* and the electrodes 412*a* and 412*d*, and between the electrode 413*e* and the electrodes 412*d* and 412*g*. These polarizing directions mainly extend along the surface direction, but are slightly slanted with respect to both of the surface and thickness directions of the piezoelectric plate 411. In this way, according to the present embodiment, in the operating part M for one ink chamber 24, a polarized portion M1 is defined as the region between the electrode 413*b* and the electrode 412*a*, and another polarized portion M2 is defined as the region between the electrode 413*b* and the electrode 412*d*. Similarly, in the operating part M for another ink chamber 24, a polarized portion M1 is defined as the region between the electrode 413*e* and the electrode 412*d*, and another polarized portion M2 is defined as the region between the electrode 413*e* and the electrode 412*g*.

Thus, according to the present embodiment, the polarization does not occur between any neighboring electrodes, but occurs between the first center electrode 413*b* and the second electrode 412*a*, and between the first center electrode 413*b* and the second electrode 412*d*. That is, the polarization occurs from the first center electrode 413*b* toward the second electrodes 412*a* and 412*d* beyond the electrodes 413*a*, 412*b*, 413*c*, and 412*c*, which are located neighboring to the first center electrode 413*b*. Thus, these polarizing directions A' mainly extend along the surface direction, but are slightly slanted with respect to the surface direction.

These polarizing directions A' extend across imaginary lines, which connect between a plurality of pairs of neighboring first and second electrodes, at about a 90 degree angle or other predetermined angles near to the 90 degree angle because these imaginary lines extend substantially along the thickness direction. More specifically, the polarizing directions A' intersect, at about a 90 degree angle or other predetermined angles, with: an imaginary line that connects between the neighboring first and second electrodes 413*a* and 412*a*, an imaginary line that connects between the neighboring first and second electrodes 413*a* and 412*b*, an imaginary line that connects between the neighboring first and second electrodes 413*b* and 412*b*, an imaginary line that connects between the neighboring first and second electrodes 413*b* and 412*c*, an imaginary line that connects between the neighboring first and second electrodes 413*c* and 412*c*, and an imaginary line that connects between the neighboring first and second electrodes 413*c* and 412*d*.

The thus produced piezoelectric transducer 410 is integrally assembled to the ink chamber unit 20 to provide the ink ejection device 401 shown in FIG. 25.

The ink ejection device 401 operates as described below.

In an initial stage of the ink ejection device 401, the internal first electrodes 413 and the internal second electrodes 412 are all connected to the ground by the power supply controller 1000. As a result, the piezoelectric transducer 410 is of a flat shape, as shown in FIG. 25. Further, each ink chamber 24 is being filled with ink.

Figure 29:
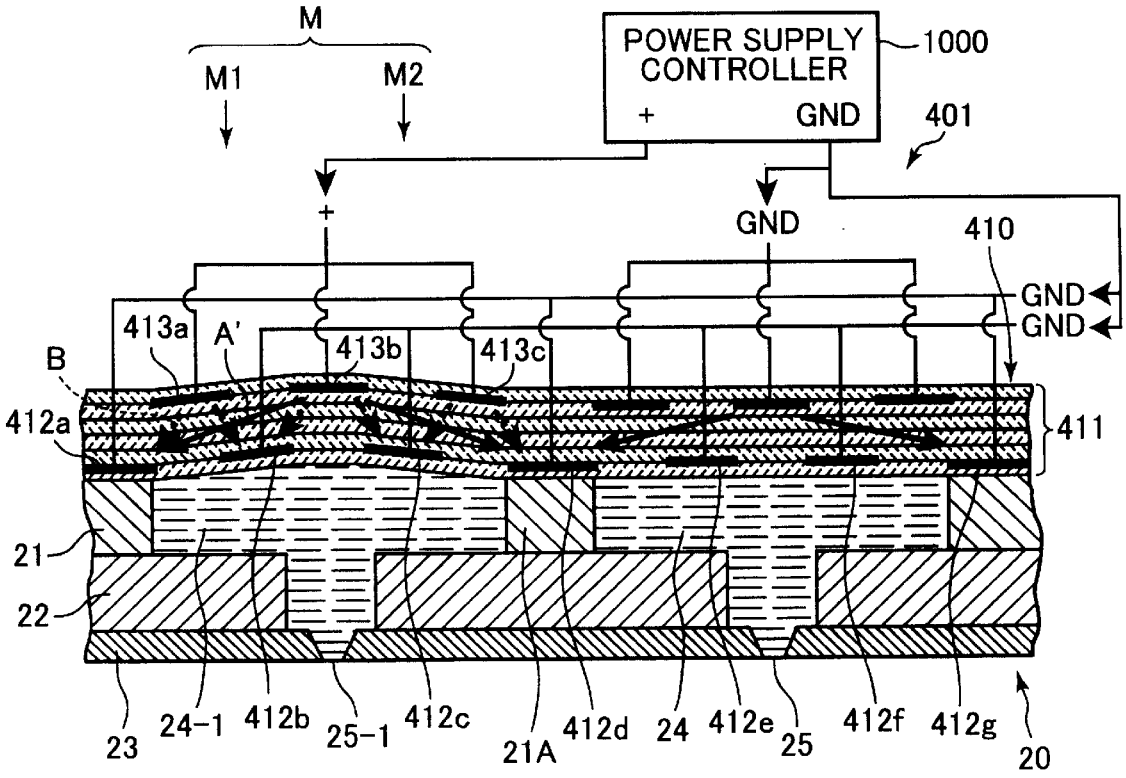
FIG. 29 is a cross-sectional view showing a deforming state of the piezoelectric transducer according to the fifth embodiment.

As shown in FIG. 29, in order to eject ink from a specific nozzle 25 (25-1) that is in communication with the specific ink chamber 24 (24-1) based on predetermined print data, a driving voltage (for example 20V) is applied from the power supply controller 1000 to the internal first electrodes 413*a*, 413*b*, 413*c*, all of which are in association with the specific ink chamber 24-1. As a result, driving electric field is generated between the internal first electrodes 413*a*, 413*b*, 413*c* and the internal second electrodes 412*a*, 412*b*, 412*c*, 412*d*, all of which are also in association with the specific ink chamber 24-1.

The driving electric field is directed approximately in the thickness direction of the piezoelectric plate 411 as shown by the broken arrows B in FIG. 29, whereas the polarizing directions A' are mainly directed in the surface direction of the plate 411 (even though the latter direction is slightly slanted with respect to the surface direction). In other words, the direction of the driving electric field is substantially perpendicular to the polarizing directions A'.

More specifically, the driving electric field is generated between the first electrode 413*b*, which has been used during the polarization process, and the internal second electrodes 412*b* and 412*c*, which are arranged between the electrodes 413*b* and 412*a* and 412*d*, which have been used during the polarization process. Accordingly, this driving electric field properly intersects with the polarized directions by about 90 degree angle. The driving electric field is generated also between the first electrode 413*a* and the second electrode 412*b*, which are located between the electrodes 413*b* and 412*a*, which have been used during the polarization process. Accordingly, this driving electric field also properly intersects with the polarized direction by about a 90 degree angle. Similarly, the driving electric field is generated also between the first electrode 413*c* and the second electrode 412*c*, which are located between the electrodes 413*b* and 412*d*, which have been used during the polarization process. Accordingly, this driving electric field also properly intersects with the polarized direction by about a 90 degree angle.

In this way, the driving electric field is applied in the operating part M for the ink chamber 24-1 substantially perpendicularly to the polarized directions A'. As a result, the pair of polarized regions M1 and M2 are symmetrically deformed with respect to the center of the specific ink chamber 24-1 in a shear mode fashion. Each polarized region M1, M2 is deformed into a parallelogramic shape. This increases an internal volume of the specific ink chamber 24-1 so that ink from the ink supply source (not shown) is supplied into the specific ink chamber 24-1.

Figure 30:
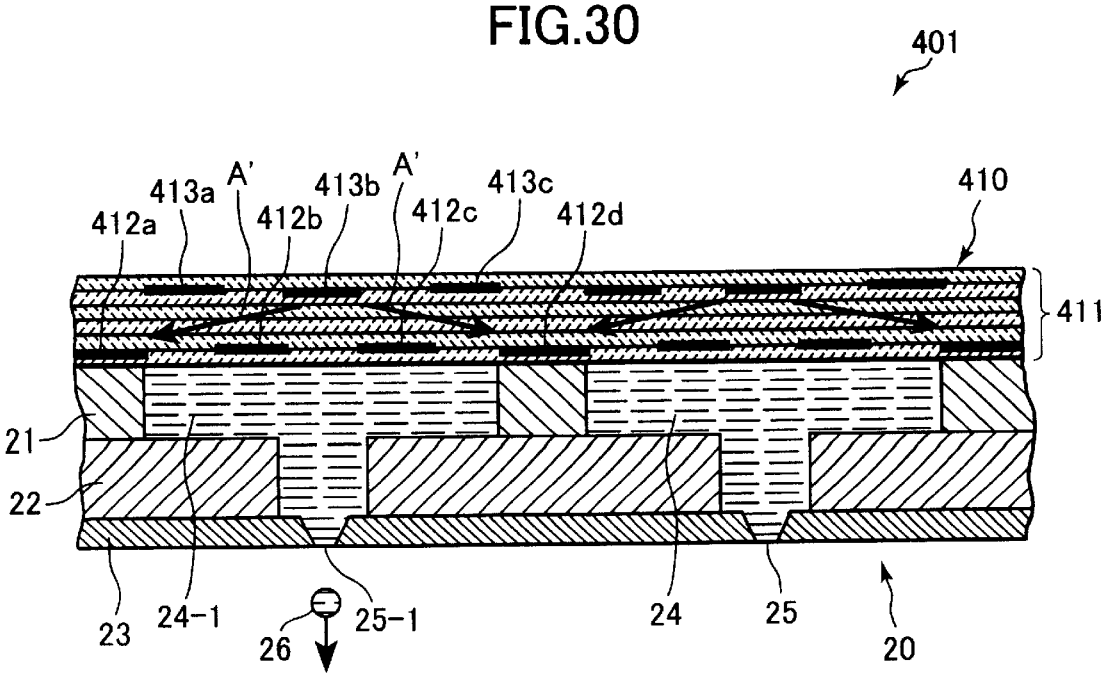
FIG. 30 is a cross-sectional view showing a liquid ejection phase according to the fifth embodiment.

Then, the power supply controller 1000 terminates supply of electrical power to the internal first electrodes 413*a*, 413*b*, 413*c*, whereupon the shape of the piezoelectric plate 411 is restored to its initial shape as shown in FIG. 30. Thus, ink pressure in the specific ink chamber 24-1 is increased to eject ink droplet 26 from the specific nozzle 25-1.

In this way, in the ink ejection device 401 according to the fifth embodiment, because the plurality of internal first and second electrodes 413 and 412 are provided in the interior of the piezoelectric plate 411, the electric field can easily be directed in a direction approximately perpendicular to or in a direction of intersection with the polarizing directions by suitably selecting the internal electrodes, to which driving voltage is applied, merely by changing the combinations of the electrodes during the polarization process and during the actual driving process. Accordingly, it is possible to eliminate the process for removing the polarizing electrodes and the process for additionally forming the driving electrodes.

Moreover, the lowermost piezoelectric ceramic layer 411*f* serves as an insulation layer, which isolates the internal electrodes from the ink. Therefore, additional protective layer is not required for preventing the electrodes from their corrosion. It is possible to reduce the production cost.

Further, because the electrodes 413 and 412 are embedded in the piezoelectric plate 411, an electric discharge between positive and ground electrodes does not occur, thereby avoiding break-down of the piezoelectric transducer 410. It is possible to enhance reliability of the resultant ink ejection device 401.

Furthermore, the piezoelectric transducer 410 can be subjected to re-polarization prior to the assembly into the ink ejection device 401. It is noted that according to the present embodiment, as shown in FIG. 26, the location of the lead parts 412A for the internal second partition electrodes 412*a*, 412*d*, 412*g* is longitudinally displaced from the location of the lead parts 412A for the other remaining second electrodes 412*b*, 412*c*, 412*e*, 412*f* to provide two groups of lead parts. Accordingly, re-polarization of the piezoelectric plate 411 can be performed even after the assembly of the plate 411 into the ink ejection device 401.

In the above description, all the internal first electrodes 413*a*, 413*b*, and 413*c*, that are in association with the specific ink chamber 24-1, are applied with the driving voltages. However, the driving voltage can be applied only to the electrodes 413*a* and 413*c*, thereby applying the driving voltage only between the first electrode 413*a* and the second electrodes 412*a* and 412*b*, and between the first electrode 413*c* and the second electrodes 412*c* and 412*d*. In such a case, it is possible to apply the driving voltage only between the first electrode 413*a* and the second electrode 412*b*, and between the first electrode 413*c* and the second electrode 412*c* by not connecting the electrodes 412*a* and 412*d* to the ground. Because the electrodes 413*a* and 412*b* are located between the electrodes 413*b* and 412*a*, which are used for polarizing the piezoelectric plate 411, the driving electric field generated between the electrodes 413*a* and 412*b* will properly intersect with the polarized direction. Similarly, because the electrodes 413*c* and 412*c* are located between the electrodes 413*b* and 412*d*, which are used for polarizing the piezoelectric plate 411, the driving electric field generated between the electrodes 413*c* and 412*c* will properly intersect with the polarized direction. It may also be possible to apply driving electric fields in the regions between the electrodes 413*a* and 412*b* and between the electrodes 413*c* and 412*c* in arbitrary directions.

In this way, according to the present embodiment, during the polarizing process, polarizing electric fields are applied through the piezoelectric plate 411 by using the first electrode 413*b* and the second electrodes 412*a* and 412*d* that substantially do not oppose with each other in the thickness direction. During the driving process, driving electric fields are applied through the piezoelectric plate 411 by using the electrodes 413*a* and 413*c* and 412*b* and 412*c* that are different from the electrodes (413*b*, 412*a*, 412*d*) used during the polarizing process and that are located between the electrodes (413*b*, 412*a*, 412*d*) used during the polarizing process. Accordingly, the driving electric fields extend properly intersecting with the polarizing directions, thereby attaining the shear mode deformation.

Sixth Embodiment

An ink ejection device 501 having a piezoelectric transducer 510 according to a sixth embodiment of the present invention will be described with reference to FIGS. 31 through 34 wherein like parts and components are designated by the same reference numerals and characters as those shown in the fifth embodiment.

The structure of the ink ejection device 501 according to the sixth embodiment is the same as that of the ink ejection device 401 according to the fifth embodiment, except for its polarizing directions and in its driving electric field directions. That is, the polarizing directions are set in the present embodiment similarly to the driving electric field directions in the fifth embodiment. The driving electric field directions are set in the present embodiment similarly to the polarizing directions in the fifth embodiment.

According to the present embodiment, a polarization plate 511, constituting the piezoelectric transducer 510, includes the sheet-shaped piezoelectric plates 511*a*–511*f* in the same manner that the polarization plate 411 includes the sheet-shaped piezoelectric plates 411*a*–411*f* (FIG. 26). Internal first electrodes 512 with lead parts 512A and internal second electrodes 513 with lead parts 513A are provided to the polarization plate 511 in the same manner that the first electrodes 412 with lead parts 412A and the second electrodes 413 with lead parts 413A are provided to the polarization plate 411 (FIG. 26). The lead parts 513A from the electrodes 513 extend through the uppermost layer 511*e* and the lead parts 512A from the electrodes 512 extend through the lowermost layer 511*f*, in the same manner that the lead parts 413A extend through the uppermost layer 411*e* and the lead parts 412A extend through the lowermost layer 411*f*. As the first internal electrodes 512, electrodes 512*a*–512*g* are arranged on the piezoelectric sheet 511*f* in the same manner that electrodes 412*a*–412*g* are arranged on the piezoelectric sheet 411*f* (FIG. 25). As the second internal electrodes 513, electrodes 513*a*–513*f* are arranged on the piezoelectric sheet 511*a* in the same manner that electrodes 413*a*–413*f* are arranged on the piezoelectric sheet 411*a* (FIG. 25).

Figure 32:
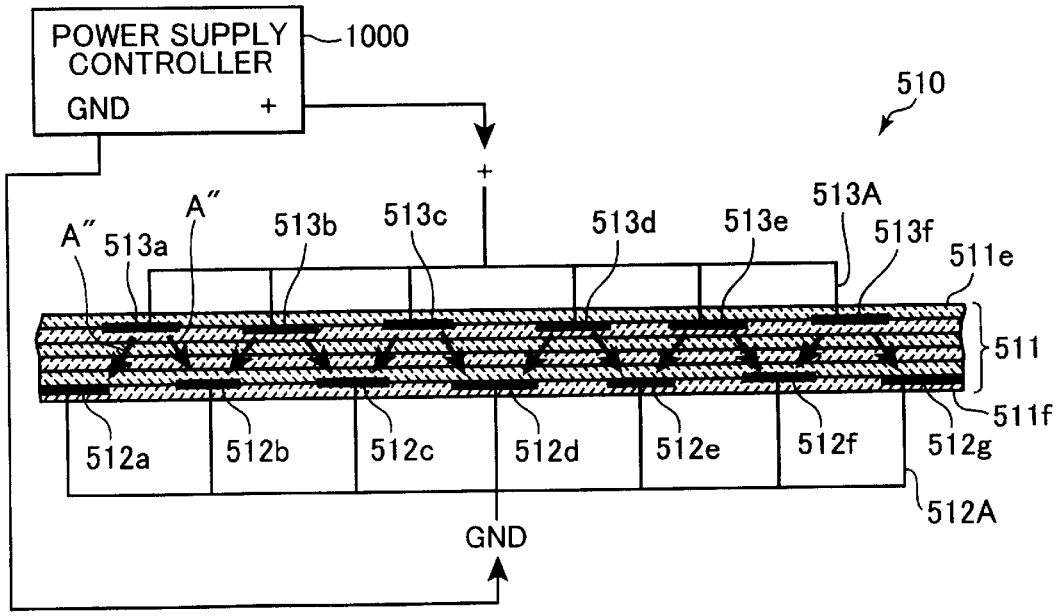
FIG. 32 is a cross-sectional view showing how a piezoelectric plate is polarized during the production process of the piezoelectric transducer in the sixth embodiment.

During the polarization process, as shown in FIG. 32, the power supply controller 1000 applies all the internal first electrodes 513 with a positive voltage through their lead parts 513A that extend through the uppermost layer 511*e*, and connects all the internal second electrodes 512 to the ground through their lead parts 512A (not shown) that extend through the lowermost layer 511*f*. As a result, polarization is directed in approximately the thickness direction of the piezoelectric plate 511 as indicated by arrows A".

In other words, the polarizing directions A" extend along the imaginary lines, which connect between a plurality of pairs of neighboring first and second electrodes (that is, an imaginary line connecting between the neighboring first and second electrodes 513*a* and 512*a*, an imaginary line connecting between the neighboring first and second electrodes 513*a* and 512*b*, an imaginary line connecting between the neighboring first and second electrodes 513*b* and 512*b*, an imaginary line connecting between the neighboring first and second electrodes 513*b* and 512*c*, an imaginary line connecting between the neighboring first and second electrodes 513*c* and 512*c*, and an imaginary line connecting between the neighboring first and second electrodes 513*c* and 512*d*).

Figure 31:
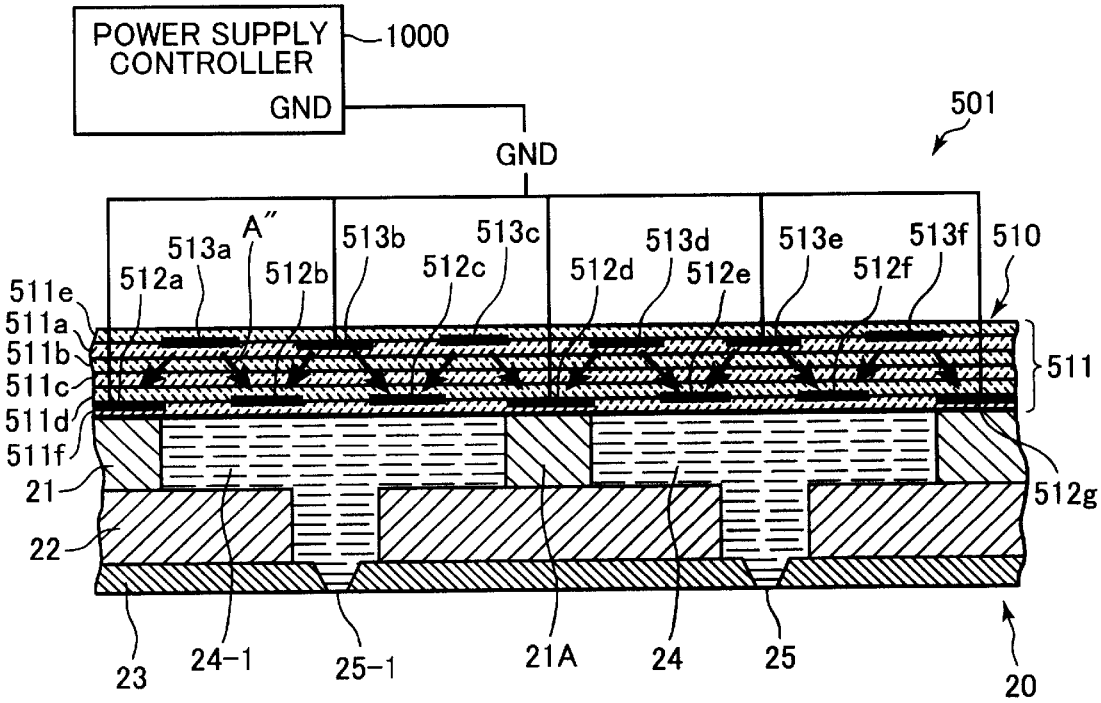
FIG. 31 is a cross-sectional view showing an ink ejection device that employs a piezoelectric transducer according to a sixth embodiment of the present invention.

In operation, in an initial phase, as shown in FIG. 31, the power supply controller 1000 connects, to the ground, the first internal electrodes 513*b*, 513*e* (center electrodes 513*b*, 513*e*), which are aligned with the centers of the ink chambers 24, and the second internal electrodes 512*a*, 512*d*, 512*g* (partition electrodes 512*a*, 512*d*, 512*g*), which are aligned with the partition walls 21A. In this condition, the piezoelectric transducer 510 is of a flat shape. Other remaining internal first electrodes 513*a*, 513*c*, 513*d*, 513*f* and other remaining internal second electrodes 512*b*, 512*c*, 512*e*, 512*f* are isolated from the electric power source 1000, and the ink chamber 24 is being filled with ink.

Figure 33:
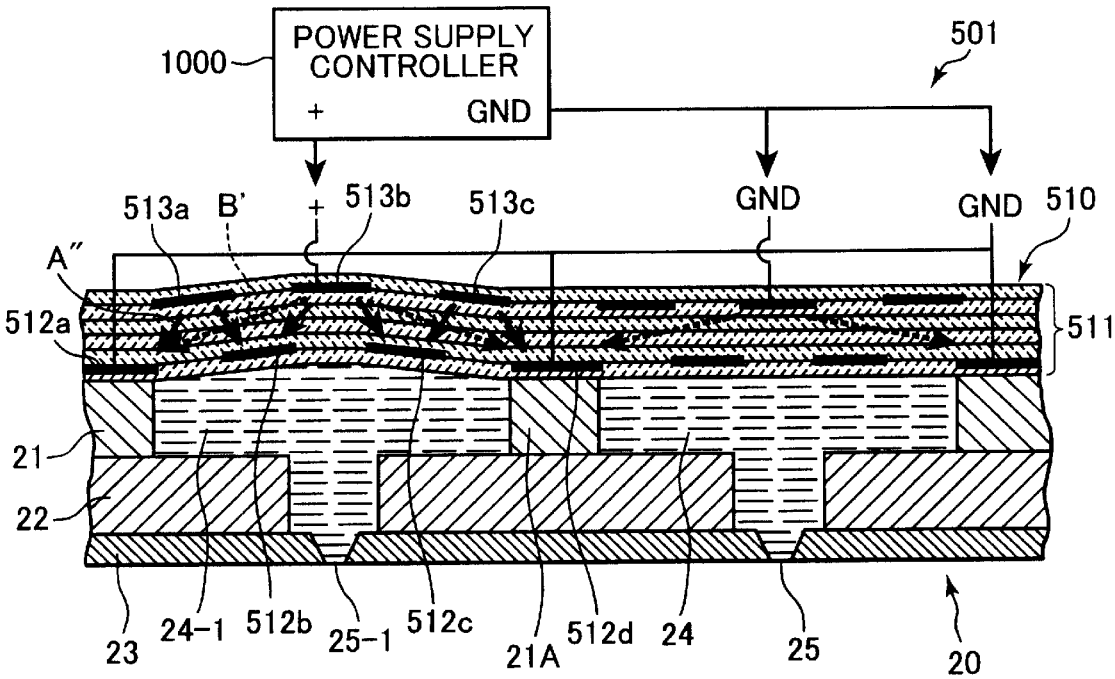
FIG. 33 is a cross-sectional view showing a deforming state of the piezoelectric transducer according to the sixth embodiment.

As shown in FIG. 33, in order to eject ink from a specific nozzle 25 (25-1) that is in communication with the specific ink chamber 24 (24-1) based on predetermined print data, the power supply controller 1000 supplies a driving voltage (for example 20V) to the center electrode 513*b* that is in association with the specific ink chamber 24-1 and that is aligned with the center of the ink chamber 24-1. As a result, driving electric fields are generated, as indicated by broken arrows B' in the figure, between the center electrode 513*b* and the partition electrodes 512*a* and 512*d*, which are aligned with the partition walls 21A in association with the specific ink chamber 24-1, and which are grounded. The electric fields from the first center electrode 513*b* extend toward the electrodes 512*a* and 512*d* beyond the neighboring electrodes 513*a*, 512*b*, 513*c*, and 512*c*.

Figure 34:
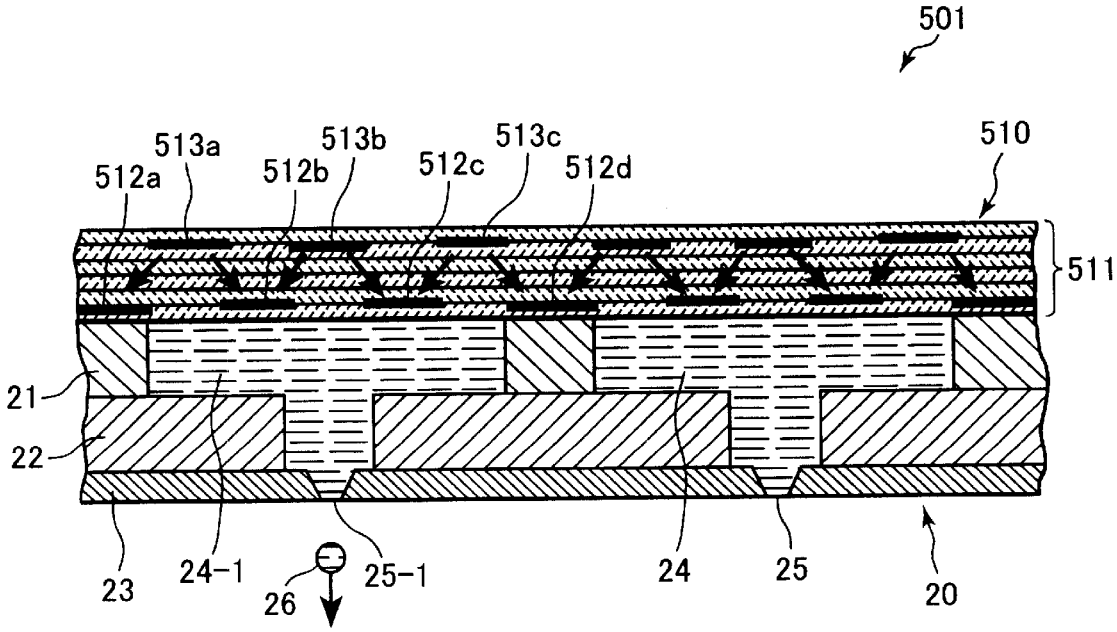
FIG. 34 is a cross-sectional view showing a liquid ejection phase according to the sixth embodiment.

Thus, the driving electric fields are mainly directed in the surface direction of the plate 511 (even though these directions are slightly slanted with respect to the surface direction as shown by the arrows B'), whereas the polarizing directions A" are approximately directed in the thickness direction of the piezoelectric plate 511 as indicated by arrows A" in FIG. 33. In other words, the directions B' of the driving electric fields are substantially perpendicular to and intersecting with the polarizing directions A", so that the part of the piezoelectric plate 511, in confrontation with the specific ink chamber 24-1, is deformed in a direction away from the specific nozzle 25-1 similar to the fifth embodiment. Then, ink droplet 26 is ejected out of the specific nozzle 25-1 as shown in FIG. 34 in accordance with the restoration of its original flat shape of the piezoelectric plate 511 in a manner similar to the fifth embodiment.

In this way, according to the present embodiment, during the polarizing process, polarizing electric fields are applied through the piezoelectric plate 511 by using first and second electrodes 513*a*–513*c* and 512*a*–512*d* that substantially oppose with each other in the thickness direction. During the driving process, driving electric fields are applied through the piezoelectric plate 511 by using the first electrode 513*b* and the second electrodes 512*a* and 512*d* that do not oppose with each other in the thickness direction. Accordingly, the driving electric fields extend properly intersecting with the polarizing directions, thereby attaining the shear mode deformation.

It may be possible to increase the thickness of the piezoelectric transducer 510, by increasing the number of the piezoelectric layers 511 constituting the piezoelectric transducer 510, in order to prevent the piezoelectric transducer 510 from being broken or damaged while the piezoelectric transducer 510 is handled during its assembling process or the like.

Figure 35:
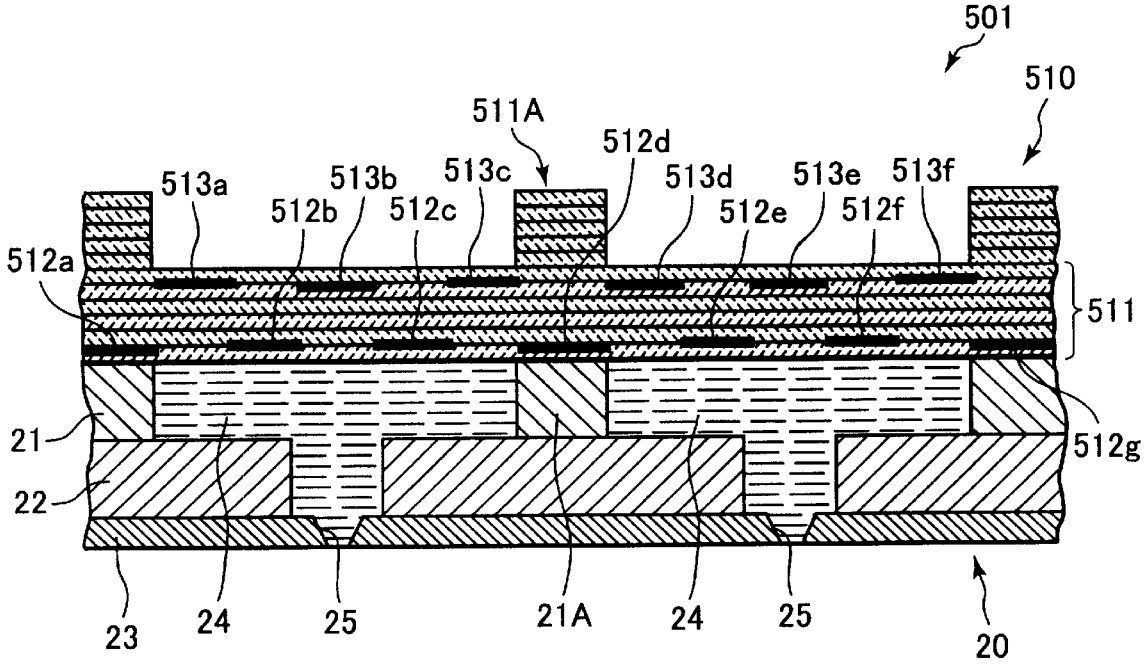
FIG. 35 is a cross-sectional view showing an ink ejection device according to a modification of the sixth embodiment

FIG. 35 shows a modification to the sixth embodiment. In FIG. 35, in addition to the piezoelectric layers 511 (511*a*–511*f*), additional piezoelectric layers 511A are partially provided at non-deformable parts of the piezoelectric plate 510, such as at positions corresponding to the respective partition walls 21A, for reinforcement. This can improve rupture resistance of the piezoelectric transducer 510.

As described above, in the piezoelectric transducers and the liquid droplet ejection devices incorporating the piezoelectric transducers according to the above-described embodiments, because either one of the driving electric field and the polarization direction is made slanted, the driving electric field can be applied substantially perpendicularly with respect to the direction of polarization. Accordingly, efficient deformation of the piezoelectric plate can be obtained even with the small number of electrodes.

Further, because the polarization electrodes and the driving electrodes are arranged symmetrically with respect to the center of each liquid chamber, the piezoelectric plate can be deformed in a direction substantially perpendicular to the surface direction, thereby providing efficient ejection of the liquid droplet.

While the invention has been described in detail and with reference to the specific embodiments thereof, it would be apparent to those skilled in the art that various changes and modifications may be made therein without departing from the spirit and scope of the invention.

For example, even though the above described embodiments pertain to the ink ejection device, the present invention can also be used for various liquid droplet ejection devices, such as other image forming devices, coating devices, spraying devices, etc.

Further, the numbers of the piezoelectric ceramic layers is not limited to the foregoing embodiments, but the number can be increased so as to enhance rupture strength of the piezoelectric transducer during assembly process.

In the fifth embodiment, the layers 411*e* and 411*f* are provided covering the first and second electrodes 413 and 412. However, the layers 411*e* and 411*f* may not be provided. It is preferred, however, that at least the layer 411*f* be provided covering the second electrodes 412. The layer 411*f* serves as an insulation layer for separating the electrodes 412 from ink in the ink chambers 24 and for preventing the electrodes 412 from being damaged by ink.

In the fifth embodiment, the electrodes 413 and 412 are arranged in the staggered manner. However, the electrodes 413 and 412 may be arranged not in the staggered manner. For example, the electrodes 413 and 412 may be arranged so that each electrode 413 will oppose with a corresponding electrode 412 in the thickness direction.

What is claimed is:

1. A piezoelectric transducer, comprising:

a piezoelectric plate, which is made of piezoelectric material and which has a pair of opposite surfaces, the piezoelectric plate having at least one actuating portion desired to be deformed and at least two non-actuating portions, each actuating portion being located as being interposed between corresponding two non-actuating portions, each actuating portion having a center, the piezoelectric plate being polarized in a pair of polarized directions, which are slanted with respect to both of a surface direction and a thickness direction and which are symmetrical with respect to the center of each actuating portion, the surface direction being defined along the opposite surfaces of the piezoelectric plate, the thickness direction being defined along a thickness of the piezoelectric plate and substantially perpendicular to the surface direction; and a pair of driving electrodes, each of which is provided on a corresponding surface of the piezoelectric plate, the pair of driving electrodes being for applying an electric field that extends substantially perpendicularly to the polarized directions, thereby causing the actuating portion to be deformed in a direction substantially perpendicular to the surface direction.

2. A piezoelectric transducer, as claimed in claim 1, wherein the piezoelectric plate is polarized in directions slanted with respect to both of the thickness direction and the surface direction, at a pair of regions which are defined between the center of each actuating portion and the two non-actuating portions that sandwich the actuating portion therebetween.

3. A piezoelectric transducer, as claimed in claim 1, wherein the piezoelectric plate is produced by stacking a plurality of piezoelectric sheets one on another, each piezoelectric sheet being made of piezoelectric material.

4. A piezoelectric transducer, as claimed in claim 1, further comprising a first internal polarizing electrode and a pair of second internal polarizing electrode, both of which are provided in the inside of the piezoelectric plate, the first internal polarizing electrode being located at a position that corresponds to the center of each actuating portion, the second internal polarizing electrodes being located at a pair of positions that correspond to the two non-actuating portions that sandwich the actuating portion therebetween, the first internal polarizing electrode being located near to one of the opposite surfaces of the piezoelectric plate, and the second internal polarizing electrodes being located near to the other one of the opposite surfaces, wherein the piezoelectric plate is polarized in each actuating portion, at a pair of polarized regions, that are defined between the first internal polarizing electrode and the pair of second internal polarizing electrodes, in a pair of directions that extend along imaginary lines connecting between the first internal polarizing electrode and the pair of second internal polarizing electrodes and that are slanted with respect to the surface direction, and wherein the pair of driving electrodes are provided on the opposite surfaces of the piezoelectric plate at each actuating portion, to thereby generate an electric field that extends in a direction substantially perpendicular to the polarized directions in the pair of polarized portions in each actuating portion.

5. A piezoelectric transducer, as claimed in claim 4, wherein the piezoelectric plate is formed by stacking a plurality of piezoelectric sheets one on another, the plurality of piezoelectric sheets being made of piezoelectric material, the first and second internal polarizing electrodes being provided between the stacked piezoelectric sheets.

6. A piezoelectric transducer, as claimed in claim 2, wherein the piezoelectric plate includes a plurality of actuating portions, which are arranged in the surface direction, a plurality of first driving electrodes being provided on one surface of the piezoelectric plate in one-to-one correspondence with the plurality of actuating portions, a single second driving electrode being provided on the other surface of the piezoelectric plate in common to the plurality of actuating portions.

7. A piezoelectric transducer, as claimed in claim 6, wherein the piezoelectric plate is polarized at the pair of polarized portions in each actuating portion, the pair of polarized portions being symmetrical with each other with respect to the center of the actuating portion, the polarized directions, in which the piezoelectric plate is polarized in the pair of polarized portions, are symmetrical with each other with respect to the center of the actuating portion, wherein each first driving electrode is located on the one surface of the piezoelectric plate at a position over both of the pair of polarized portions in the corresponding actuating portion.

8. A piezoelectric transducer as claimed in claim 1, further comprising a wall having at least two partition walls that define at least one liquid chamber therebetween, the liquid chamber being filled with liquid, the wall being connected to one of the pair of opposite surfaces of the piezoelectric plate so that each actuating portion in the piezoelectric plate is located at a position corresponding to a corresponding liquid chamber, the center of the actuating portion corresponding to the center of the liquid chamber, each non-actuating portion corresponding to a corresponding partition wall, wherein the piezoelectric plate is polarized in a pair of polarized directions at a pair of polarized portions in each actuating portion, the pair of polarized portions being defined as a pair of regions between the center of the actuating portion and the two non-actuating portions that sandwich the actuating portion therebetween, the polarized directions being symmetrical with each other with respect to the center of the actuating portion and slanted with respect to both of the thickness direction and the surface direction, the actuating portion being deformed in the direction perpendicular to the surface direction, to thereby change the volume of the liquid chamber and allow the liquid to be ejected from the liquid chamber.

9. A piezoelectric transducer, as claimed in claim 8, wherein the wall includes a plurality of partition walls that define a plurality of liquid chambers arranged in a direction substantially parallel with the surface direction, the piezoelectric plate having a plurality of actuating portions in one-to-one correspondence with the plurality of liquid chambers and having a plurality of non-actuating portions in one-to-one correspondence with the plurality of partition walls, wherein the piezoelectric plate is provided over the plurality of liquid chambers so that the center of each actuating portion corresponds to the center of the corresponding liquid chamber and so that two non-actuating portions sandwiching each actuating portion corresponds to two partition walls sandwiching the corresponding liquid chamber, wherein the piezoelectric plate is polarized in directions slanted with respect to the thickness direction in each actuating portion at a pair of regions, which are defined between the center of the actuating portion and the two non-actuating portions that sandwich the actuating portion therebetween.

10. A piezoelectric transducer, comprising:

a piezoelectric plate which is made of piezoelectric material and which has a pair of opposite surfaces, the pair of opposite surfaces extending in a predetermined surface direction and being opposed to each other along a predetermined thickness direction, the predetermined thickness direction being substantially perpendicular to the predetermined surface direction;

a first electrode group and a second electrode group provided to the piezoelectric plate, the first electrode group and the second electrode group being distant from each other in the thickness direction, the first electrode group including a plurality of first electrodes arranged in the surface direction as being separated from one another, and the second electrode group including a plurality of second electrodes arranged in the surface direction as being separated from one another, the plurality of first and second electrodes including:

at least one polarizing combination of first and second electrodes, between which a polarizing electric field is to be applied to polarize the piezoelectric plate; and at least one driving combination of first and second electrodes, between which a driving electric field is to be applied to actuate the piezoelectric plate, the driving combination of first and second electrodes being different from the polarizing combination of first and second electrodes, an imaginary line connecting between the driving combination of first and second electrodes substantially intersecting with an imaginary line connecting between the polarizing combination of first and second electrodes, thereby allowing the piezoelectric plate to be deformed in a shear mode fashion upon driven by the driving combination of first and second electrodes.

11. A piezoelectric transducer as claimed in claim 10, further comprising a liquid chamber unit defining a plurality of liquid chambers, the liquid chamber unit being connected to one of the pair of opposite surfaces of the piezoelectric plate, the piezoelectric plate being provided over the plurality of liquid chambers, wherein one polarizing combination of first and second electrodes is defined for each liquid chamber, the first and second electrodes constituting the one polarizing combination are located substantially symmetrically with respect to the center of the liquid chamber, thereby allowing the polarizing electric field to be generated substantially symmetrically with respect to the center of the liquid chamber, and wherein one driving combination of first and second electrodes is defined for each liquid chamber, the one driving combination including a plurality of pairs of first and second electrodes that are located substantially symmetrically with respect to the center of the liquid chamber to allow the driving electric field to be generated to extend substantially intersecting with the polarizing electric field, whereby when the driving electric field is generated between the plurality of pairs of first and second electrodes in the driving combination for one selected liquid chamber, the volume of the liquid chamber is changed to allow a liquid droplet is ejected from the liquid chamber.

12. A piezoelectric transducer as claimed in claim 11, wherein the liquid chamber unit includes a plurality of partition walls, each two adjacent partition walls defining a corresponding liquid chamber therebetween, wherein the one polarizing combination of first and second electrodes, defined for each liquid chamber, includes one first electrode that is located at a position substantially corresponding to the center of the liquid chamber, and two second electrodes that are located at two positions substantially corresponding to the two adjacent partition walls that sandwich the liquid chamber therebetween.

13. A piezoelectric transducer as claimed in claim 11, wherein the second electrode group is provided on the one surface of the piezoelectric plate that confronts the liquid chambers, the first electrode group is provided on the other surface of the piezoelectric plate, and further comprising an insulation layer provided covering the second electrode group on the piezoelectric plate and separating the second electrode group from the liquid chambers.

14. A piezoelectric transducer as claimed in claim 10, wherein the first and second electrodes are arranged in a manner that at least one second electrode is located neighboring to each first electrode in the thickness direction, the polarizing combination of first and second driving electrodes including one first electrode and at least one second electrode that is different from at least one second electrode neighboring to the first electrode, the driving combination of first and second driving electrodes including one first electrode and at least one second electrode neighboring to the first electrode, thereby allowing the imaginary line connecting between the driving combination of first and second electrodes to substantially intersect with the imaginary line connecting between the polarizing combination of first and second electrodes.

15. A piezoelectric transducer as claimed in claim 14, wherein the imaginary line connecting between the polarizing combination of first and second electrodes extends substantially in the surface direction, and the imaginary line connecting between the driving combination of first and second electrodes extends substantially in the thickness direction.

16. A piezoelectric transducer as claimed in claim 15, wherein the polarizing combination of first and second electrodes includes one first electrode and at least one second electrode that is located as being shifted, along the surface direction, from a position opposing the first electrode in the thickness direction, the driving combination of first and second electrodes including at least one electrode that is different from the electrodes in the polarizing combination and that is located between the electrodes in the polarizing combination.

17. A piezoelectric transducer as claimed in claim 16, further comprising a liquid chamber unit including a plurality of partition wails defining a plurality of liquid chambers, each two adjacent partition walls defining a corresponding liquid chamber therebetween, the piezoelectric plate being provided over the plurality of liquid chambers, wherein one polarizing combination of first and second electrodes is defined for each liquid chamber, the polarizing combination including one first electrode that is located at a position substantially corresponding to the center of the liquid chamber, and two second electrodes that are located at two positions substantially corresponding to the two adjacent partition walls sandwiching the liquid chamber therebetween, and wherein one driving combination of first and second electrodes is defined for each liquid chamber, the one driving combination including a plurality of pairs of first and second electrodes that are located symmetrically with respect to the center of the liquid chamber, whereby when the driving electric field is generated between the plurality of pairs of first and second electrodes in the driving combination for one selected liquid chamber, the volume of the liquid chamber is changed to allow a liquid droplet to be ejected from the liquid chamber.

18. A piezoelectric transducer as claimed in claim 16, wherein the polarizing combination of first and second electrodes includes one first electrode and at least one second electrode that is different from the at least one second electrode neighboring to the first electrode, the driving combination of first and second electrodes including the first electrode in the polarizing combination and at least one second electrode that is different from the second electrode in the polarizing combination and that is located between the electrodes in the polarizing combination.

19. A piezoelectric transducer as claimed in claim 10, wherein the first and second electrodes are arranged in a manner that at least one second electrode is located neighboring to each first electrode in the thickness direction, the polarizing combination of first and second driving electrodes including one first electrode and at least one second electrode neighboring to the first electrode, the driving combination of first and second driving electrodes including one first electrode and at least one second electrode that is different from at least one second electrode neighboring to the first electrode, thereby allowing the imaginary line connecting between the driving combination of first and second electrodes to substantially intersect with the imaginary line connecting between the polarizing combination of first and second electrodes.

20. A piezoelectric transducer as claimed in claim 19, wherein the imaginary line connecting between the polarizing combination of first and second electrodes extends substantially in the thickness direction, and the imaginary line connecting between the driving combination of first and second electrodes extends substantially in the surface direction.

21. A piezoelectric transducer as claimed in claim 20, wherein the polarizing combination of first and second electrodes includes one first electrode and at least one second electrode that is located at a position substantially opposing the first electrode in the thickness direction, the driving combination of first and second electrodes including a first electrode and at least one second electrode that is located as being shifted, along the surface direction, from a position opposing the first electrode in the thickness direction.

22. A piezoelectric transducer as claimed in claim 21, further comprising a liquid chamber unit including a plurality of partition walls defining a plurality of liquid chambers, each two adjacent partition walls defining a corresponding liquid chamber therebetween, the piezoelectric plate being provided over the plurality of liquid chambers, wherein one polarizing combinations of first and second electrodes is defined for each liquid chamber, the one polarizing combination including a plurality of pairs of first and second electrodes that are located symmetrically with respect to the center of the liquid chamber, and wherein one driving combination of first and second electrodes is defined for each liquid chamber, the driving combination including one first electrode that is located at a position substantially corresponding to the center of the liquid chamber, and two second electrodes that are located at two positions substantially corresponding to the two adjacent partition walls sandwiching the liquid chamber therebetween, whereby when the driving electric field is generated between the first electrode and the two second electrodes in the driving combination for one selected liquid chamber, the volume of the liquid chamber is changed to allow a liquid droplet to be ejected from the liquid chamber.

23. A liquid droplet ejection device, comprising:

a piezoelectric plate, which is made of piezoelectric material and which has a pair of opposite surfaces, the piezoelectric plate having at least one actuating portion desired to be deformed, the pair of opposite surfaces extending in a predetermined surface direction and being opposed to each other along a predetermined thickness direction, the predetermined thickness direction being substantially perpendicular to the predetermined surface direction; and a wall having at least two partition walls that define at least one liquid chamber therebetween, the liquid chamber being filled with liquid, the wall being connected to one of the pair of opposite surfaces of the piezoelectric plate so that each actuating portion in the piezoelectric plate is located at a position corresponding to a corresponding liquid chamber, the center of the actuating portion corresponding to the center of the liquid chamber, the piezoelectric plate being polarized in a pair of polarized directions at a pair of polarized portions in each actuating portion, the pair of polarized portions being defined as a pair of regions between a position corresponding to the center of the liquid chamber and a position corresponding to the two partition walls that sandwich the liquid chamber therebetween, the polarized directions being symmetrical with each other with respect to the center of the liquid chamber and slanted with respect to both of the thickness direction and the surface direction; and a pair of driving electrodes, each of which is provided on a corresponding surface of the piezoelectric plate, the pair of driving electrodes being for applying an electric field that extends substantially perpendicularly to the polarized directions, thereby causing the actuating portion to be deformed in a direction substantially perpendicular to the surface direction, to thereby change the volume of the liquid chamber and allow the liquid to be ejected from the liquid chamber.

24. A liquid droplet ejection device, comprising:

a piezoelectric plate which is made of piezoelectric material and which has a pair of opposite surfaces, the pair of opposite surfaces extending in a predetermined surface direction and being opposed to each other along a predetermined thickness direction, the predetermined thickness direction being substantially perpendicular to the predetermined surface direction;

a liquid chamber unit defining a plurality of liquid chambers, the liquid chamber unit being connected to one of the pair of opposite surfaces of the piezoelectric plate, the piezoelectric plate being provided over the plurality of liquid chambers;

a first electrode group and a second electrode group provided to the piezoelectric plate, the first electrode group and the second electrode group being distant from each other in the thickness direction, the first electrode group including a plurality of first electrodes arranged in the surface direction as being separated from one another, the second electrode group including a plurality of second electrodes arranged in the surface direction as being separated from one another; and an energizing unit applying a polarizing electric field between at least one polarizing combination of first and second electrodes, and applying a driving electric field between at least one driving combination of first and second electrodes, the driving combination of first and second electrodes being different from the polarizing combination of first and second electrodes, an imaginary line connecting between the driving combination of first and second electrodes substantially intersecting with an imaginary line connecting between the polarizing combination of first and second electrodes, whereby the energizing unit allows the piezoelectric plate to be deformed in a shear mode fashion, when applying the driving electric field between the driving combination of first and second electrodes, thereby allowing the volume of the liquid chamber to be changed and allowing the liquid chamber to eject a liquid droplet therefrom.

25. A liquid droplet ejection device, as claimed in claim 24, wherein one polarizing combination of first and second electrodes is defined for each liquid chamber, the first and second electrodes constituting the one polarizing combination being located substantially symmetrically with respect to the center of the liquid chamber, thereby allowing the polarizing electric field to be generated substantially symmetrically with respect to the center of the liquid chamber, and wherein one driving combination of first and second electrodes is defined for each liquid chamber, the one driving combination including a plurality of pairs of first and second electrodes that are located substantially symmetrically with respect to the center of the liquid chamber, thereby allowing the driving electric field to extend substantially intersecting with the polarizing electric field, whereby when the energizing unit applies the driving electric field between the plurality of pairs of first and second electrodes in the driving combination for one selected liquid chamber, the volume of the liquid chamber is changed to allow a liquid droplet to be ejected from the liquid chamber.

26. A liquid droplet ejection device, as claimed in claim 24, wherein the liquid chamber unit includes a plurality of partition walls defining the plurality of liquid chambers, each two adjacent partition walls defining a corresponding liquid chamber therebetween, wherein one polarizing combination of first and second electrodes is defined for each liquid chamber, the polarizing combination including one first electrode that is located at a position substantially corresponding to the center of the liquid chamber, and two second electrodes that are located at two positions substantially corresponding to the two adjacent partition walls sandwiching the liquid chamber therebetween, and wherein one driving combination of first and second electrodes is defined for each liquid chamber, the one driving combination including a plurality of pairs of first and second electrodes that are located symmetrically with respect to the center of the liquid chamber, whereby when the energizing unit applies the driving electric field between the plurality of pairs of first and second electrodes in the driving combination for one selected liquid chamber, the volume of the liquid chamber is changed to allow a liquid droplet to be ejected from the liquid chamber.

27. A liquid droplet ejection device, as claimed in claim 24, wherein the liquid chamber unit includes a plurality of partition walls defining the plurality of liquid chambers, each two adjacent partition walls defining a corresponding liquid chamber therebetween, wherein one polarizing combinations of first and second electrodes is defined for each liquid chamber, the one polarizing combination including a plurality of pairs of first and second electrodes that are located symmetrically with respect to the center of the liquid chamber, and wherein one driving combination of first and second electrodes is defined for each liquid chamber, the driving combination including one first electrode that is located at a position substantially corresponding to the center of the liquid chamber, and two second electrodes that are located at two positions substantially corresponding to the two adjacent partition walls sandwiching the liquid chamber therebetween, whereby when the energizing unit applies the driving electric field between the first electrode and the two second electrodes in the driving combination for one selected liquid chamber, the volume of the liquid chamber is changed to allow a liquid droplet to be ejected from the liquid chamber.

* * * * *